US012723342B2

(12) United States Patent
Jang et al.

(10) Patent No.: US 12,723,342 B2
(45) Date of Patent: Sep. 1, 2026

(54) LAUNDRY TREATING APPARATUS

(71) Applicant: LG ELECTRONICS INC., Seoul (KR)

(72) Inventors: Ho Sung Jang, Seoul (KR); Sang Hee Yoo, Seoul (KR); Hyeok Jin Gwon, Seoul (KR); Ji Hyun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 188 days.

(21) Appl. No.: 18/840,830

(22) PCT Filed: Sep. 20, 2023

(86) PCT No.: PCT/KR2023/014283
§ 371 (c)(1),
(2) Date: Aug. 22, 2024

(87) PCT Pub. No.: WO2024/147431
PCT Pub. Date: Jul. 11, 2024

(65) Prior Publication Data

US 2025/0179714 A1 Jun. 5, 2025

(30) Foreign Application Priority Data

Jan. 3, 2023 (KR) ..... 10-2023-0000727

(51) Int. Cl.

| | |
|---|---|
| ***D06F 34/32*** | (2020.01) |
| ***D06F 23/02*** | (2006.01) |
| ***D06F 34/30*** | (2020.01) |
| ***D06F 34/34*** | (2020.01) |

(Continued)

(52) U.S. Cl.
CPC ..... *D06F 34/32* (2020.02); *D06F 23/02* (2013.01); *D06F 34/30* (2020.02); *D06F 34/34* (2020.02); *D06F 39/12* (2013.01); *D06F 2105/58* (2020.02)

(58) Field of Classification Search
CPC ..... D06F 34/32
See application file for complete search history.

(56) References Cited

U.S. PATENT DOCUMENTS 5,694,793 A 12/1997 Nishimura et al.

FOREIGN PATENT DOCUMENTS

| | | | |
|---|---|---|---|
| CN | 112941823 | A | 6/2021 |
| KR | 10-2013-0109356 | A | 10/2013 |
| KR | 10-2015-0006264 | A | 1/2015 |

(Continued)

*Primary Examiner* — Jason Y Ko
(74) *Attorney, Agent, or Firm* — Birch, Stewart, Kolasch & Birch, LLP

(57) ABSTRACT

A laundry treating apparatus for performing a processing operation for laundry includes a control panel for inputting control signals. The apparatus includes a body configured to accommodate laundry and a cover defining an exterior of the body. The cover includes a through hole located at a front upper end portion of the cover. The cover includes a control panel located at an inner surface of the cover. The control panel is partially exposed to an exterior of the cover through the through hole to allow a user to input a control signal for the processing operation. The control panel includes a window. An area of the window corresponding to the through hole has a first portion and a remaining portion. The first portion is provided as a transmissive area, and the remaining portion is provided as a non-transmissive area. A touch screen is visible through the transmissive area.

20 Claims, 12 Drawing Sheets

(51) Int. Cl.
*D06F 39/12* (2006.01)
*D06F 105/58* (2020.01)

(56) References Cited

FOREIGN PATENT DOCUMENTS

| | | | |
|---|---|---|---|
| KR | 10-2018-0089990 | A | 8/2018 |
| KR | 10-2257622 | B1 | 5/2021 |
| KR | 10-2022-0125131 | A | 9/2022 |
| KR | 10-2022-0160203 | A | 12/2022 |
| WO | Wo 2012/175523 | A1 | 12/2012 |
| WO | Wo 2017/078340 | A1 | 5/2017 |

LAUNDRY TREATING APPARATUS

CROSS REFERENCE TO RELATED APPLICATIONS

This application is the National Phase of PCT International Application No. PCT/KR2023/014283, filed on Sep. 20, 2023, which claims priority under 35 U.S.C. 119(a) to Patent Application No. 10-2023-0000727, filed in the Republic of Korea on Jan. 3, 2023, all of which are hereby expressly incorporated by reference into the present application.

TECHNICAL FIELD

The present disclosure relates to a laundry treating apparatus and, more specifically, to a laundry treating apparatus in which a control signal for a processing cycle can be input through a control panel.

BACKGROUND

In general, a laundry treating apparatus is an apparatus that processes laundry by applying physical and chemical actions to the laundry. The term "laundry treating apparatus" is used to collectively refer to a washing apparatus that removes contaminants from laundry, a spin-drying apparatus that spin-dries laundry by rotating a washing tub containing laundry at high speed, a drying apparatus that dries wet laundry by applying hot air into the washing tub, and the like.

In this regard, laundry treating apparatuses that have recently appeared do not just perform washing, dry-washing, and drying functions individually in respective apparatuses, but are configured to perform all of the above-mentioned functions together in one laundry treating apparatus.

Accordingly, when processing laundry, a series of operations such as a washing course, a rinsing course, a spin-drying course, a drying course, and the like can be appropriately controlled through a user's manipulation or automatic control.

A typical laundry treating apparatus includes a control panel configured to be capable of displaying visual information related to a processing operation to a user and capable of receiving user input. That is, the control panel is provided for a user interface (UI).

Accordingly, the control panel may include input units or selection units, such as various buttons for user operation, and various display units to provide information to a user. All of these various input units, selection units, and display units may be referred to as user interfaces.

Meanwhile, in accordance with the recent trend of placing importance on the exterior design of laundry treating apparatuses, a cabinet cover that defines the exterior of the laundry treating apparatus may be designed as an integrated sheet metal product to achieve a seamless structure. In this case, the control panel provided on the front surface of the laundry treating apparatus to facilitate user access and operation also needs to match the exterior design of the laundry treating apparatus, which is designed to have the seamless structure.

Regarding a laundry treating apparatus including a control panel as described above, Korean Patent No. 10-2257622 (hereinafter, referred to as "Prior Art Document 1") discloses a washing apparatus.

Specifically, a control panel provided on the front upper portion of a cabinet cover to face the front of the product, an operation unit installed on the control panel to select a specific wash course and accompanying options by rotating a knob, a display configured to selectively display the wash course and options based on the operation of the operation unit, and the like are disclosed.

In the case of the laundry treating apparatus in Prior Art Document 1, in view of the fact that the control panel is installed to be separated from the front surface of the cabinet cover by a parting line, there are inevitably limitations in designing the laundry treating apparatus with a seamless structure.

In addition, since the structure of the control panel is relatively complex in that a rotary knob for user operation is applied, there is a problem in that a structure for coupling the control panel to a cabinet cover designed as an integrated sheet metal product also becomes complicated.

In addition, Korean Patent Laid-open Publication No. 10-2013-0109356 (hereinafter, referred to as "Prior Art Document 2") discloses a washing machine.

Specifically, a cabinet, a control panel disposed on the front surface of the cabinet, a display unit mounted on the control panel such that the front surface thereof is exposed in front of the control panel, and the like are disclosed.

In the laundry treating apparatus of Prior Art Document 2, since the control panel is also installed separated by a parting line at the front top of the cabinet, there are inevitably limitations in designing the laundry treating apparatus in a seamless structure.

In addition, the display unit is provided in a touch screen type and performs both input and display functions. However, there is a problem in that the display unit is not directly coupled to the cabinet, but has a complex structure in which the display unit is assembled to the cabinet in the state of being installed to a control panel assembly.

As described above, in the case of a laundry treating apparatus that includes a control panel, there is also a problem in that the control panel should be easily installed on the cabinet cover while also ensuring that the control panel also matches the exterior design of the cabinet cover.

However, the conventional laundry treating apparatuses have limitations in that the above-mentioned problems cannot be adequately solved.

DISCLOSURE

Technical Problem

The present disclosure is to solve the above-mentioned problems of a laundry treating apparatus including a control panel.

Specifically, the present disclosure is to provide a laundry treating apparatus in which a parting line between a cabinet cover and a control panel is minimized, so that that the control panel can match the exterior design with a seamless structure.

In addition, the present disclosure is to provide a laundry treating apparatus in which only the portions of a control panel that are essential to be exposed to a user are exposed outside, so that the control panel can match the exterior design with a seamless structure.

In addition, the present disclosure is to provide a laundry treating apparatus in which more diverse exterior designs can be implemented by optimizing the structure of an externally exposed portion of the control panel.

The technical problems to be addressed by the present disclosure are not limited to those described above, and other technical problems, which are not described above, will be clearly understood by a person ordinarily skilled in the related art to which the present disclosure belongs.

Technical Solution

In order to achieve the above or other objects, the laundry treating apparatus according to an aspect of the present disclosure is configured such that no parting line is formed between a cabinet cover and a control panel on exterior. Specifically, the control panel is installed inside the cabinet cover that forms the exterior so that the control panel is not separated from the cabinet cover on the exterior.

In addition, the laundry treating apparatus according to an aspect of the present disclosure is configured such that the portions of the control panel that are not directly necessary for user operation is not exposed outside. Specifically, the control panel is installed inside the cabinet cover, and only a portion of the control panel is configured to be exposed outside through the first through hole provided in the cabinet cover.

In addition, the laundry treating apparatus according to an aspect of the present disclosure is configured such that the portion of the control panel exposed outside the cabinet cover is appropriately formed to match the shape of the first through hole. Specifically, the laundry treating apparatus is configured such that the touch screen is displayed through a transmissive area provided in a portion of the window, and the remaining portion of the window is provided as a non-transmissive area.

In addition, in the laundry treating apparatus according to an aspect of the present disclosure, the first through hole is opened relatively larger than the touch screen, and the portion of the first through hole where the touch screen is not displayed may be covered by a non-transmissive area of the window.

In addition, in the laundry treating apparatus according to an aspect of the present disclosure, the touch screen may have a height relatively smaller than the diameter of the first through hole provided in a circular shape.

In addition, in the laundry treating apparatus according to an aspect of the present disclosure, UIs may be arranged in a fixed UI section and a variable UI section, respectively, which are provided on the control panel, depending on the characteristics thereof.

In addition, in the laundry treating apparatus according to an aspect of the present disclosure, the fixed UI section and the variable UI section of the control panel may be provided as a non-transmissive area and a transmissive area, respectively.

In addition, in the laundry treating apparatus according to an aspect of the present disclosure, the fixed UI section may be operated by a button rod contact type.

In addition, in the laundry treating apparatus according to an aspect of the present disclosure, the variable UI section may be operated by a touch type.

In addition, in the laundry treating apparatus according to an aspect of the present disclosure, the window in the control panel may be bonded to the inner surface of the cabinet cover, and a coating guide supporting the touch screen may be fastened to the inner surface of the cabinet cover.

In addition, in the laundry treating apparatus according to an aspect of the present disclosure, a board cover on which a printed circuit board is installed may be coupled to the rear surface of the coating guide.

In addition, in the laundry treating apparatus according to an aspect of the present disclosure, a panel frame, which presses the rear surface of the control panel, may be coupled to the inner surface of the cabinet cover.

In addition, the laundry treating apparatus according to an aspect of the present disclosure may include a first sealing member interposed between the window and the coating guide.

In addition, the laundry treating apparatus according to an aspect of the present disclosure may include a second sealing member interposed between the coating guide and the board cover.

In addition, in the laundry treating apparatus according to an aspect of the present disclosure, the control panel may be fastened to a hook protrusion protruding from the second through hole provided in the cabinet cover.

In addition, in the laundry treating apparatus according to an aspect of the present disclosure, a hook at the lower end portion of the control panel is inserted into and fastened to a hook hole penetrating the hook protrusion in the longitudinal direction.

In addition, in the laundry treating apparatus according to an aspect of the present disclosure, the upper end portion of the control panel may be screwed to the inner surface of the cabinet cover.

In addition, in the laundry treating apparatus according to an aspect of the present disclosure, a control button is installed inside the cabinet cover, and a portion of the control button may be exposed outside through the second through hole provided in the cabinet cover.

Solutions to the technical problems to be achieved in the present disclosure are not limited to the solutions described above, and other solutions not described above will be clearly understood by a person ordinarily skilled in the art to which the present disclosure belongs from the description below.

DETAILED DESCRIPTION

Figure 1:
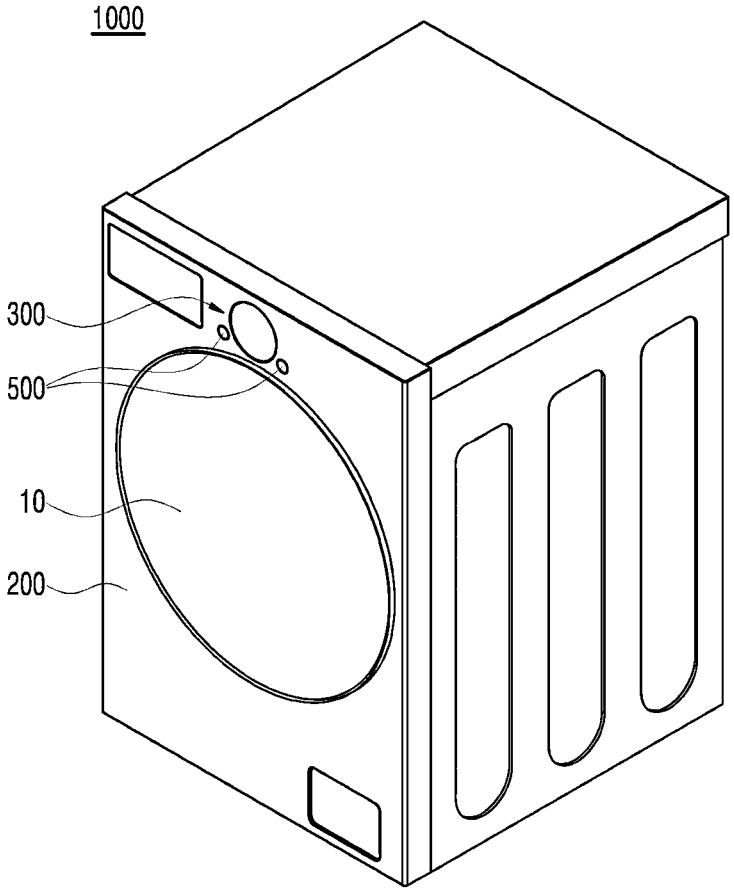
FIG. 1 is a perspective view illustrating a laundry treating apparatus according to an embodiment of the present disclosure.

Hereinafter, exemplary embodiments disclosed herein will be described in detail with reference to the accompanying drawings, and like reference numerals designate like elements, and redundant descriptions thereof will be omitted. The suffixes "module" and "unit" for components used in the following description are given or used interchangeably only for the ease of preparing the specification, and do not have distinct meanings or roles in themselves. In addition, in describing the embodiments disclosed herein, when it is determined that detailed descriptions of related known technologies may obscure the gist of the embodiments disclosed herein, the detailed descriptions will be omitted. In addition, it should be understood that the accompanying drawings are only for easy understanding of the embodiments disclosed herein, and that the technical idea disclosed herein is not limited by the accompanying drawings, and includes all changes, equivalents, and substitutes included in the spirit and technical scope of the present disclosure.

Terms containing ordinal numbers, such as first and second, may be used to describe various components, but the components are not limited by the terms. These terms are used only for the purpose of distinguishing one component from another.

When a component is referred to as being "connected" or "joined" to another component, it is to be understood that the component may be directly connected to or joint to the other component, but that other components may be present therebetween. In contrast, when a component is referred to as being "directly connected" or "directly joined" to another component, it is to be understood that no other components are present therebetween.

Singular expressions include plural expressions unless the context clearly dictates otherwise.

Herein, it is to be understood that the terms such as "include" and "have" are intended to indicate the presence of features, numbers, steps, operations, components, parts described in the description, or combinations thereof, but are not intended to preclude the possibility of presence or addition of one or more other features, numbers, steps, operations, components, parts, or combinations thereof.

Figure 2:
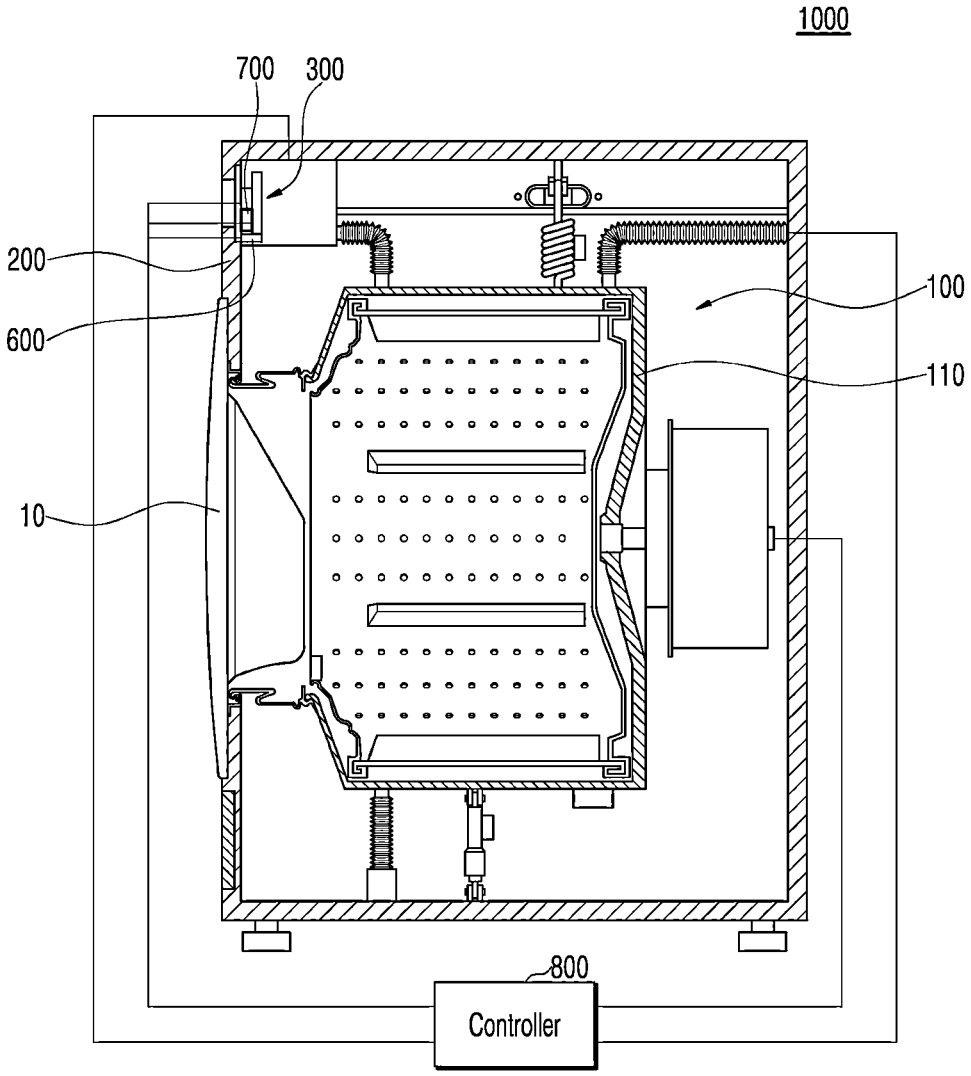
FIG. 2 is a view schematically illustrating the main configuration of a laundry treating apparatus according to an embodiment of the present disclosure.

FIG. 1 is a perspective view illustrating a laundry treating apparatus 1000 according to an embodiment of the present disclosure. FIG. 2 is a view schematically illustrating the main configuration of the laundry treating apparatus 1000 according to an embodiment of the present disclosure.

As illustrated in FIGS. 1 and 2, the laundry treating apparatus 1000 according to an embodiment of the present disclosure includes a main body 100, a cabinet cover 200, and a control panel 300.

The main body 100 is a part that accommodates laundry to perform processing operations for the laundry, and is capable of performing at least one of washing, rinsing, spin-drying, and drying.

In this case, the main body 100 may include a washing tub 110 in which laundry is put into an internal space so that at least one of washing, rinsing, dehydration, and drying can be performed. A laundry inlet for putting laundry into the washing tub 110 may be provided on one surface of the washing tub 110.

In addition, the laundry inlet may be configured to be opened/closed by a door 10 so that the laundry inlet can be closed by the door 10 during at least one of washing, rinsing, spin-drying, and drying.

Meanwhile, the washing tub 110 may include a tub configured to contain washing water. This tub may be placed on a damper installed on a base forming the bottom surface of the cabinet cover 200, is connected to a spring, which is installed inside the cabinet cover 200, in a suspended manner, and may be cushioned and supported by the damper and the spring.

This tub has a cylindrical structure laid on its side, and a drum may be disposed inside the tub, and a motor, which is a driving mechanism configured to rotate the drum, may be installed on the rear surface of the tub.

The drum is a part configured to accommodate laundry, may be configured as a cylindrical structure in which the lower portion is laid on its side like the tub to be submerged in the washing water in the tub, and may be rotatably disposed inside the tub.

The drum has a plurality of holes provided in its peripheral portion to allow washing water or air to enter and exit therethrough, and a lifter configured to lift and drop laundry may be mounted on the inner circumferential surface of the peripheral portion.

The cabinet cover 200 is a part that covers the main body 100 to form the exterior, and the main components of the main body 100 may be placed in the internal space of the cabinet cover. In addition, the above-mentioned door 10 may be installed on a portion of the cabinet cover 200. In addition, a controller 800 is installed inside the cabinet cover 200 to control the main components related to the processing operations of the laundry treating apparatus 1000 described above.

In addition, a control panel 300 may be installed on the cabinet cover 200, and via the control panel 300, the laundry treating apparatus 1000 may display visual information related to the processing operations to a user and receive user input. That is, the control panel 300 may be provided for a user interface (UI).

In this case, the control panel 300 may be installed in the front upper portion of the cabinet cover 200 to facilitate user access and operation. To this end, the cabinet cover 200 may have a first through hole 201 in the front upper end portion, and the control panel 300 may be disposed in this first through hole 201.

Meanwhile, in accordance with the recent trend of placing importance on the exterior design of laundry treating apparatuses 1000, a cabinet cover 200 that defines the exterior of the laundry treating apparatus 1000 may be designed as an integrated sheet metal product to achieve a seamless structure.

In this case, the control panel 300 disposed in the front upper end portion of the cabinet cover 200 to facilitate user access and operation also needs to match the exterior design of the laundry treating apparatus 1000, which is designed in a seamless structure.

For this purpose, the control panel 300 is installed inside the cabinet cover 200, and may be partially exposed outside through the first through hole 201 so that control signals for processing operations can be input by a user.

That is, the control panel 300 may be installed inside the cabinet cover 200, rather than being installed to be separated from the front surface of the cabinet cover 200 by a parting line.

In this way, in the laundry treating apparatus 1000 according to the present embodiment, the control panel 300 is installed inside the cabinet cover 200 that forms the exterior so that the control panel 300 is not separated from the cabinet cover 200 on the exterior. Therefore, the aesthetics and productivity of the laundry treating apparatus 1000 can be improved by designing the cabinet cover 200 as an integrated sheet metal product.

In addition, in the laundry treating apparatus 1000 according to the present embodiment, the control panel 300 is installed inside the cabinet cover 200, and only a portion of the control panel 300 is exposed outside through the first through hole 201 in the cabinet cover 200. Therefore, by minimizing the exposure of portions of the control panel 300 that do not need to be exposed to a user, the exterior design of the laundry treating apparatus 1000 can be implemented in a seamless structure.

Figure 3:
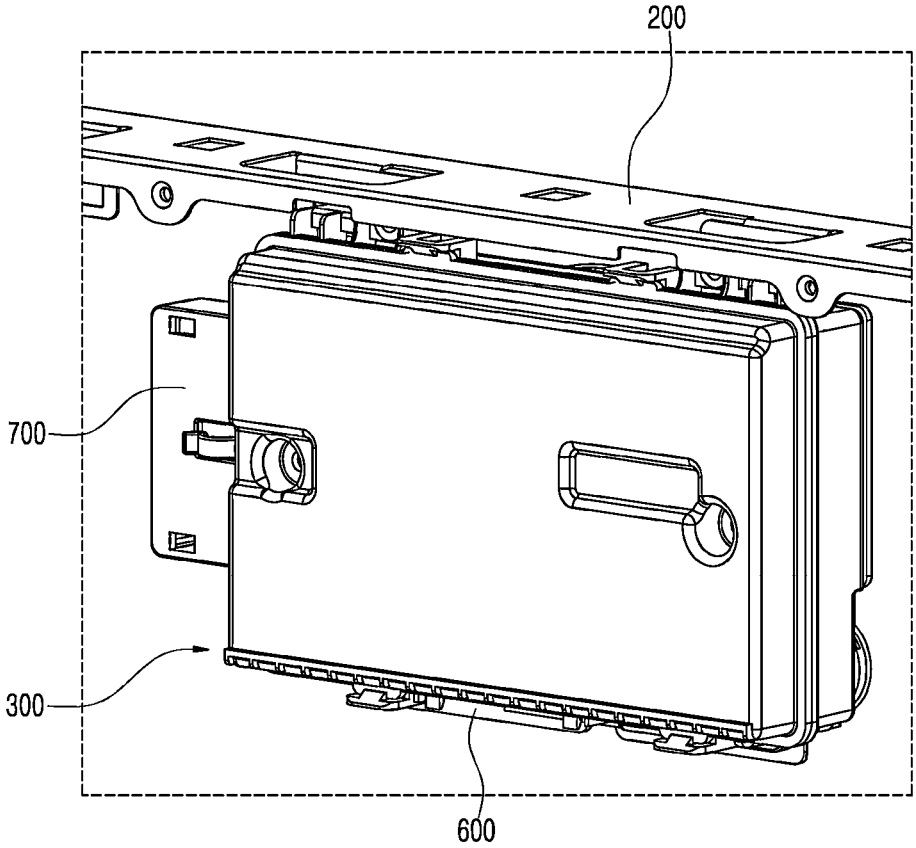
FIG. 3 is a view illustrating a control panel installed on a cabinet cover in the laundry treating apparatus according to an embodiment of the present disclosure.
Figure 4:
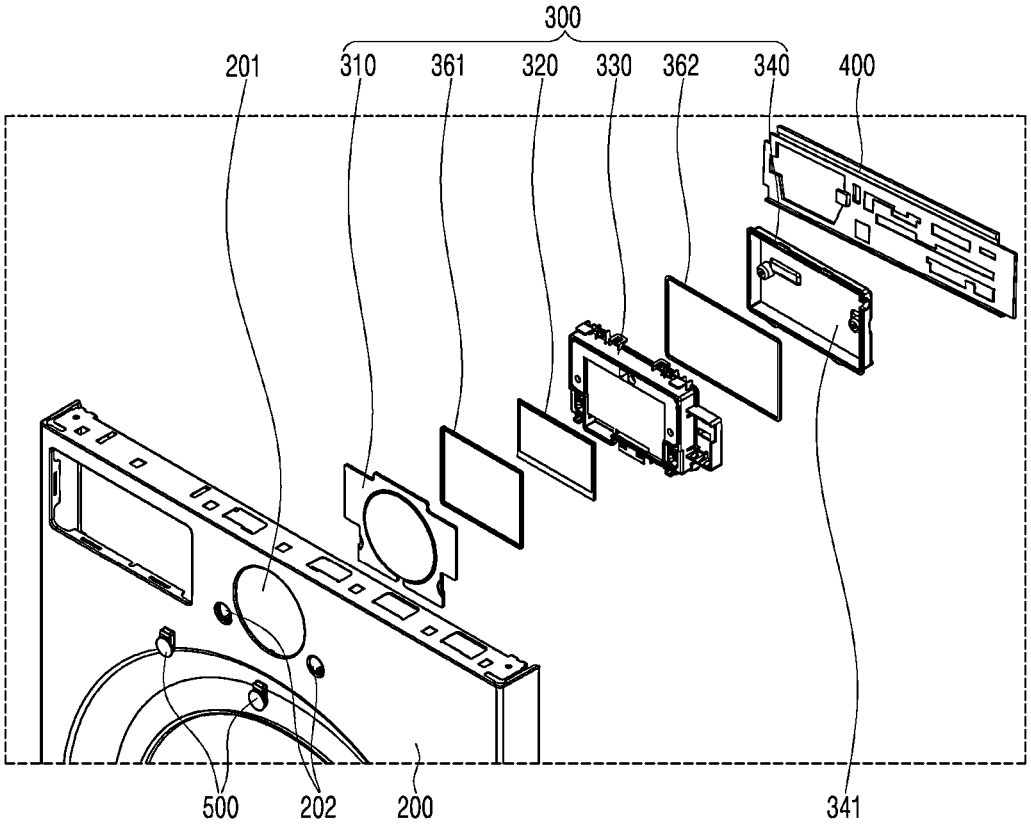
FIG. 4 is an exploded perspective view illustrating the control panel installed on the cabinet cover in the laundry treating apparatus according to an embodiment of the present disclosure.
Figure 5:
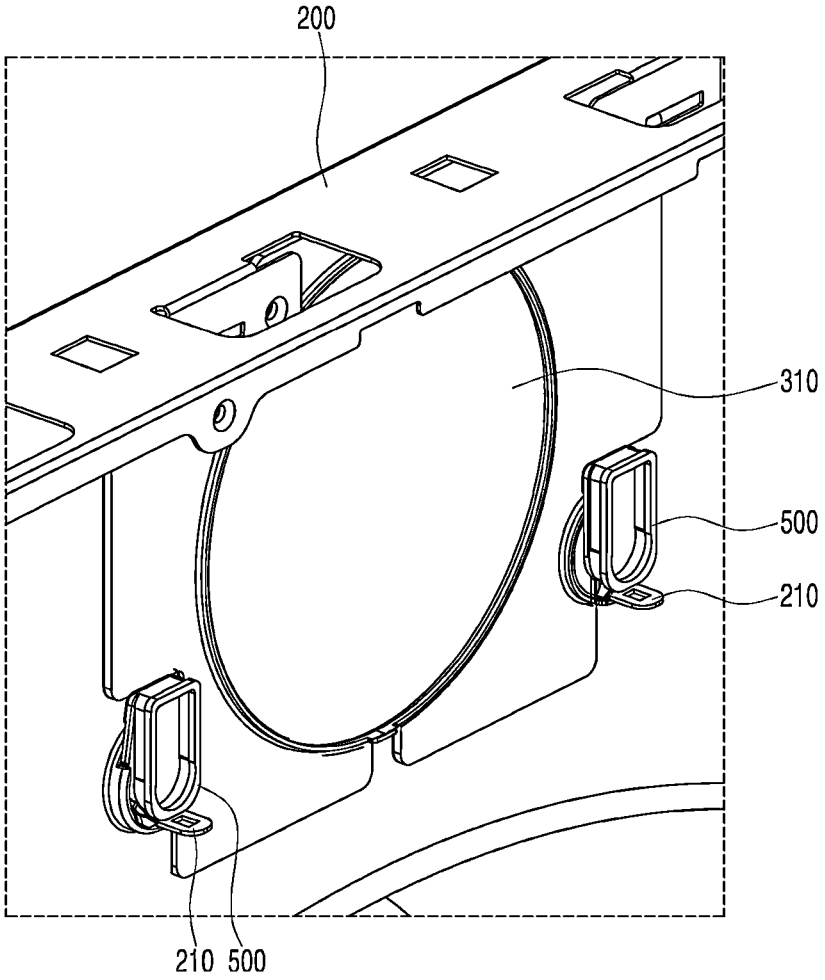
FIGS. 5 and 6 are views illustrating a state in which a window of the control panel is bonded to the inner surface of the cabinet cover in the laundry treating apparatus according to an embodiment of the present disclosure.
Figure 6:
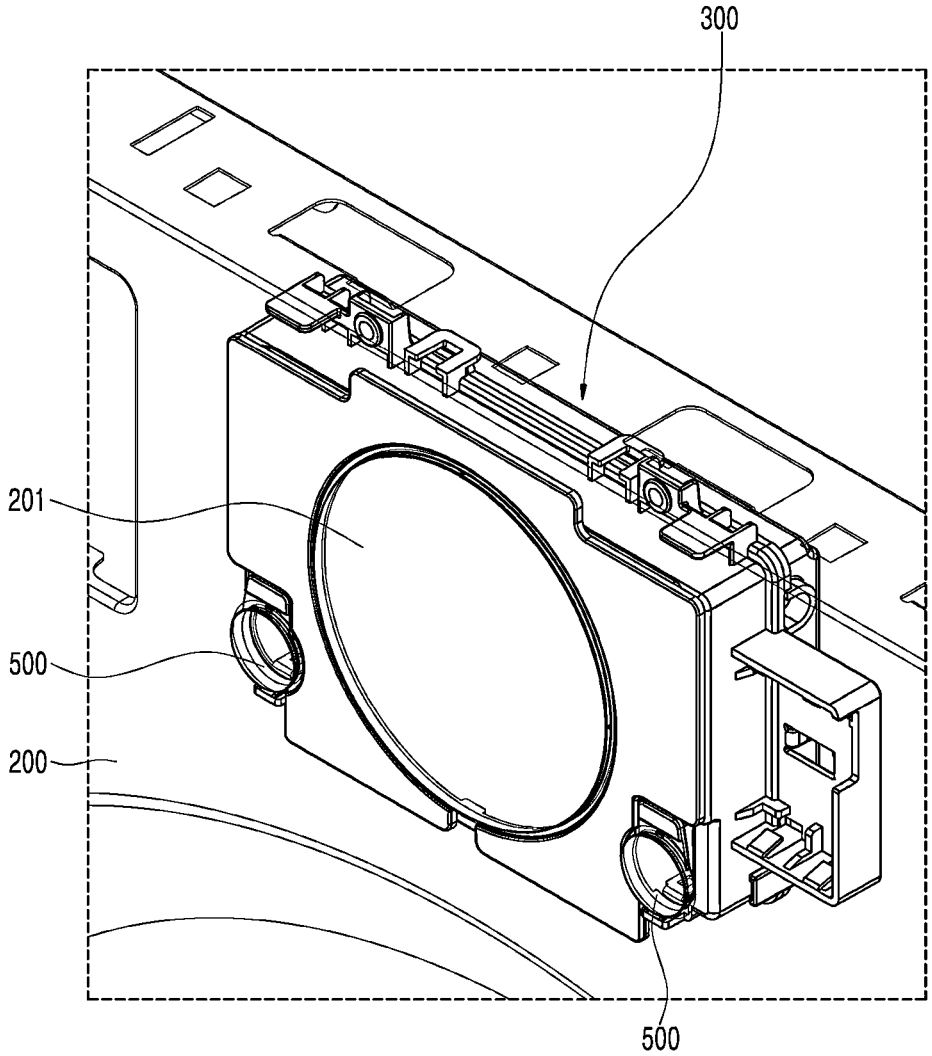
Figure 7:
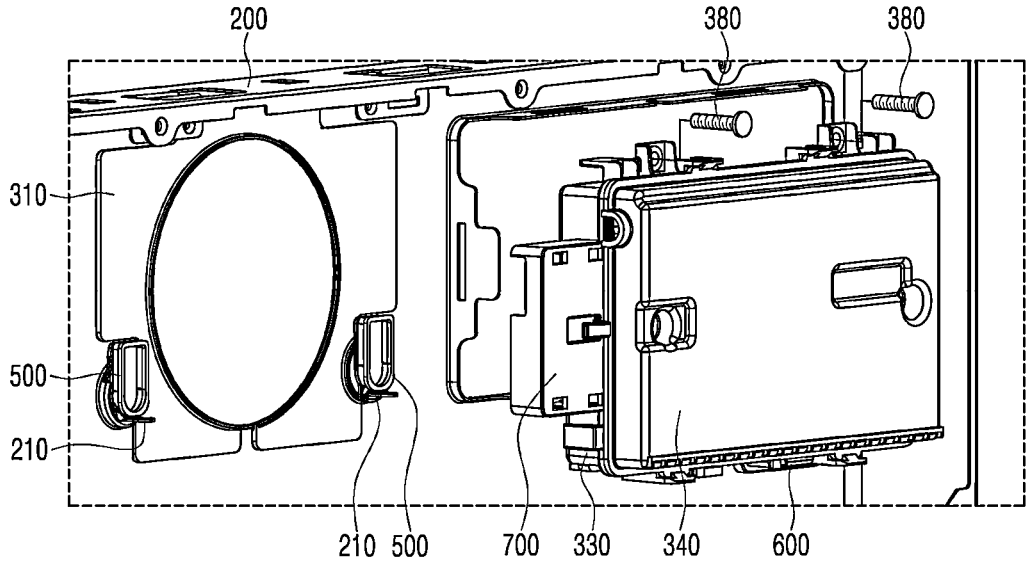
FIG. 7 is a view illustrating a state in which a coating guide of the control panel is fastened to the inner surface of the cabinet cover in the laundry treating apparatus according to an embodiment of the present disclosure.

FIG. 3 is a view illustrating the control panel 300 installed on the cabinet cover 200 in the laundry treating apparatus 1000 according to an embodiment of the present disclosure. FIG. 4 is an exploded perspective view illustrating the control panel 300 to be installed on the cabinet cover 200 in the laundry treating apparatus 1000 according to an embodiment of the present disclosure. FIGS. 5 and 6 are views illustrating a state in which the window 310 of the control panel 300 is attached to the inner surface of the cabinet cover 200 in the laundry treating apparatus 1000 according to an embodiment of the present disclosure. FIG. 7 is a view illustrating a state in which a coating guide 330 of the control panel 300 is fastened to the inner surface of the cabinet cover 200 in the laundry treating apparatus 1000 according to an embodiment of the present disclosure.

In the laundry treating apparatus 1000 according to an embodiment of the present disclosure, the control panel 300 includes a window 310, a touch screen 320, and a coating guide 330.

The window 310 is a part in which the front surface other than the area corresponding to the first through hole 201 is bonded to the inner surface of the cabinet cover 200, and may have a structure in which a portion of the front surface of the control panel 300 is bonded to and supported on the inner surface of the cabinet cover 200.

That is, the window 310 has a relatively larger area than the first through hole 201, so that the central portion of the window 310 may be disposed in the first through hole 201, and the remaining outer portion may be bonded to the cabinet cover 200.

Meanwhile, the window 310 may have a step formed between the area corresponding to the first through hole 201 and the remaining portion. That is, the central portion of the window 310 may have a shape that protrudes forward from the remaining outer portion, so that the central portion of the window 310 can be inserted into the first through hole 201.

In this case, there is no step between the front surface of the central portion of the window 310 and the outer surface of the cabinet cover 200, so that aesthetic appearance can be ensured.

The touch screen 320 is a part coupled to the rear surface of the window 310, and may be a screen configured to allow, when a touch object such as a human hand or an object (e.g., a stylus pen) touches the text displayed on the screen or a specific location of the screen, input data to be received directly from the screen so that the location can be identified and specific processing can be performed by stored software.

In this case, the touch screen 320 may be provided with touch sensors. The touch sensors may detect a touch input applied to the touch screen 320 using at least one of various touch types such as a resistive type, a capacitive type, an infrared type, an ultrasonic type, and a magnetic field type.

In this way, when there is a touch input to the touch sensors, corresponding signals may be sent to the control box. The control box may process the signals and then transmit corresponding data to a controller 800. As a result, the controller 800 may identify which areas of the touch screen 320 are touched, or the like. Here, the control box may be a separate component from the controller 800 or may be the controller 800 itself.

Meanwhile, the controller 800 may perform different controls or the same control depending on the type of a touch object that touches the touch screen 320. Whether to perform different controls or the same controls depending on the type of the touch object may be determined depending on the operating state of the laundry treating apparatus 1000 or the running application.

Accordingly, the touch screen 320 is capable of not only displaying visual information related to the processing operations of the laundry treating apparatus 1000 to the user, but also receiving user input for the processing operations of the laundry treating apparatus 1000.

That is, the touch screen 320 of the control panel 300 may simultaneously perform the functions of various display units for providing information to a user, as well as the functions of an input unit or a selection unit for user operation.

In this case, the touch screen 320 may include at least one of a liquid crystal display (LCD), a thin film transistor-liquid crystal display (TFT LCD), an organic light-emitting Diode (OLED), a flexible display, a 3D Display, and an electronic ink (E-ink) display.

The coating guide 330 is a part that is fastened to the inner surface of the cabinet cover 200 while supporting the touch screen 320 on the rear surface of the touch screen 320, and may have a structure in which a portion of the control panel 300 other than the front surface is fastened to and supported on the inner surface of the cabinet cover 200.

That is, the coating guide 330 may be fastened to the inner surface of the cabinet cover 200 by pressing the rear surface of the window 310 in the state in which the touch screen 320 is coupled to the front surface thereof.

Accordingly, the control panel 300 may have a structure in which a portion of the front surface of the overall structure is bonded to the inner surface of the cabinet cover 200, and a portion other than the front surface is fastened to the inner surface of the cabinet cover 200.

In this case, the coating guide 330 on which the touch screen 320 is supported may be coated to prevent external moisture or the like from penetrating into the touch screen 320.

In this way, in the laundry treating apparatus 1000 according to the present embodiment, since the window 310 of the control panel 300 is bonded to the inner surface of the cabinet cover 200, and the coating guide 330, which supports the touch screen 320, is fastened to the inner surface of the cabinet cover 200, the control panel 300 directly coupled inside the cabinet cover 200 can be easily and stably installed.

In the laundry treating apparatus 1000 according to an embodiment of the present disclosure, the control panel 300 may further include a board cover 340 that is coupled to the rear surface of the coating guide 330 in the state in which a printed circuit board (PCB) 341 connected to the touch screen 320 is installed thereon.

That is, the printed circuit board 341 may have various circuit components mounted thereon and be connected to the touch screen 320. Accordingly, input and output signals for the touch screen 320 may be connected to the controller 800 via the printed circuit board 341. In this case, the printed circuit board 341 may be the above-described control box or the controller 800 itself.

Meanwhile, a hole is provided in a portion of the coating guide 330 to make the front surface and the rear surface communicate with each other, so that the touch screen 320 and the printed circuit board 341 can be electrically connected to each other.

In order to protect and stably install the printed circuit board 341, the printed circuit board 341 may be installed on the board cover 340 and connected to the touch screen 320. In particular, the board cover 340 may be coupled to the rear surface of the coating guide 330 on the front surface of which the touch screen 320 is disposed, thereby allowing the touch screen 320 and the printed circuit board 341 to be disposed adjacent to each other.

In this way, in the laundry treating apparatus 1000 according to the present embodiment, since the board cover 340 on which the printed circuit board 341 is installed is coupled to the rear surface of the coating guide 330, the stably installed printed circuit board 341 can be easily connected to the touch screen 320.

Figure 8:
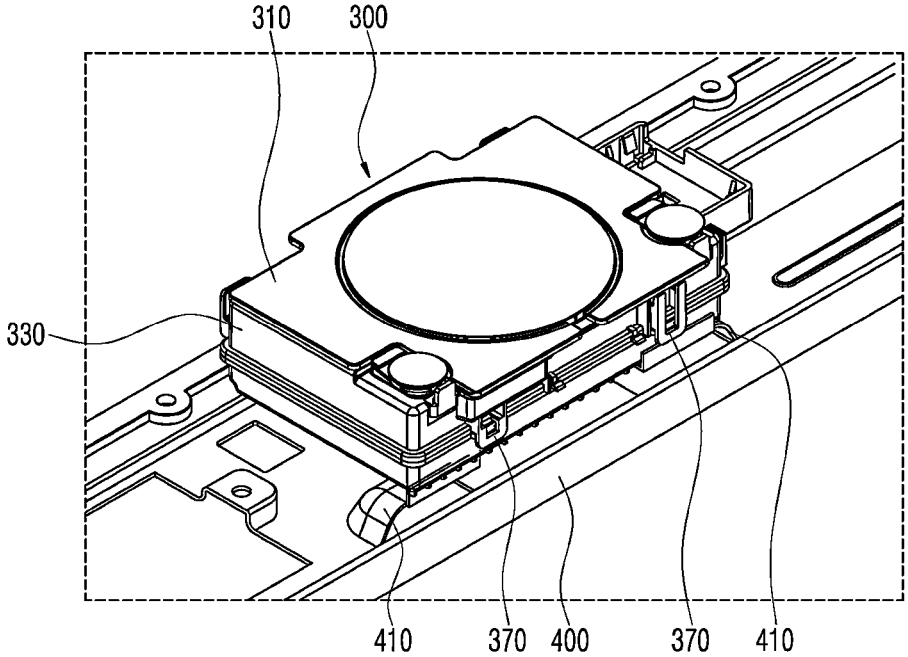
FIG. 8 is a view illustrating a state in which the panel frame presses the rear surface of the control panel in the laundry treating apparatus according to an embodiment of the present disclosure.

FIG. 8 is a view illustrating a state in which the panel frame 400 presses the rear surface of the control panel 300 in the laundry treating apparatus 1000 according to an embodiment of the present disclosure.

The laundry treating apparatus 1000 according to an embodiment of the present disclosure may further include a panel frame 400 configured to press the rear surface of the control panel 300 and coupled to the inner surface of the cabinet cover 200.

Even when the control panel 300 is installed inside the cabinet cover 200 with the above-described structure, the control panel 300 may be removed due to shock, vibration, or the like.

In particular, in view of the fact that a user should manipulate the control panel 300 installed inside the cabinet cover 200 in the manner of applying force inward from the outside of the cabinet cover 200, there is a risk that the control panel 300 may be detached toward the rear side when used continuously.

Therefore, by installing the panel frame 400 on the rear surface of the control panel 300 and making the panel frame 400 press the rear surface of the control panel 300, it may be desirable to prevent the control panel 300 from being detached toward the rear side.

In this way, in the laundry treating apparatus 1000 according to the present embodiment, since the panel frame 400 configured to press the rear surface of the control panel 300 is coupled to the inner surface of the cabinet cover 200, it is possible to prevent the control panel 300 from being removed by shock, vibration, and the like.

In the laundry treating apparatus 1000 according to an embodiment of the present disclosure, the panel frame 400 may be provided with a frame protrusion 410 that protrudes from the front surface thereof to be capable of pressing the rear surface of the board cover 340.

That is, since the frame protrusions 410 protrudes from the front surface of the panel frame 400, and a portion of this frame protrusion 410 has a bent shape, there is room for elastic deformation when an external force is applied thereto.

Therefore, even when shock and vibration are applied to the control panel 300, the frame protrusion 410 that presses the rear surface of the control panel 300 can absorb the shock and vibration while being elastically deformed.

In this way, in the laundry treating apparatus 1000 according to the present embodiment, since the frame protrusion 410 provided on the panel frame 400 press the rear surface of the board cover 340, shock and vibration applied to the control panel 300 can be partially alleviated.

In the laundry treating apparatus 1000 according to an embodiment of the present disclosure, the control panel 300 may further include a first sealing member 361 interposed between the window 310 and the coating guide 330.

Since the touch screen 320 is disposed between the window 310 and the coating guide 330, there is a risk that the touch screen 320 may be damaged when the space between the window 310 and the coating guide 330 is excessively narrow.

Therefore, it may be desirable to minimize the pressure applied to the touch screen 320 by interposing the first sealing member 361 between the window 310 and the coating guide 330.

In addition, when external moisture or the like penetrates into the space between the window 310 and the coating guide 330, there is a risk that the function of the touch screen 320 may be deteriorated.

Therefore, it may be desirable to interpose the first sealing member 361 between the window 310 and the coating guide 330 to prevent moisture from penetrating into the portions that the coating guide 330 does not cover.

In this way, in the laundry treating apparatus 1000 according to the present embodiment, since the first sealing member 361 is interposed between the window 310 and the coating guide 330, waterproofing and shock resistance performance can be secured at the coupling portion between the window 310 and the coating guide 330.

In the laundry treating apparatus 1000 according to an embodiment of the present disclosure, the control panel 300 may further include a second sealing member 362 interposed between the coating guide 330 and the board cover 340.

Since the printed circuit board 341 is disposed between the coating guide 330 and the board cover 340, there is a risk that the printed circuit board 341 may be damaged when the space between the coating guide 330 and the board cover 340 is excessively narrow.

Therefore, it may be desirable to minimize the pressure applied to the printed circuit board 341 by interposing the second sealing member 362 between the coating guide 330 and the board cover 340.

In addition, when external moisture or the like penetrates into the space between the coating guide 330 and the board cover 340, there is a risk that the function of the printed circuit board 341 may be deteriorated.

Therefore, it may be desirable to interpose the second sealing member 362 between the coating guide 330 and the board cover 340 to prevent moisture from penetrating into the portions that the board cover 340 does not cover.

In this way, in the laundry treating apparatus 1000 according to the present embodiment, since the second sealing member 362 is interposed between the coating guide 330 and the board cover 340, waterproofing and shock resistance performance can be secured at the coupling portion between the coating guide 330 and the board cover 340.

Figure 9:
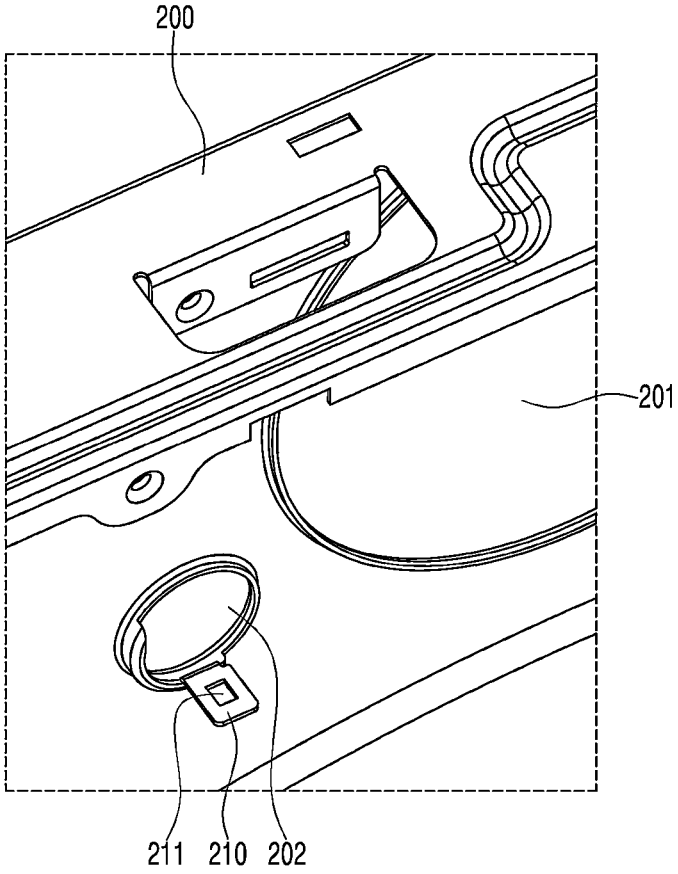
FIG. 9 is a view illustrating in more detail a hook protrusion provided on the cabinet cover in the laundry treating apparatus according to an embodiment of the present disclosure.

FIG. 9 is a view illustrating in more detail the hook protrusion 210 on the cabinet cover 200 in the laundry treating apparatus 1000 according to an embodiment of the present disclosure.

In the laundry treating apparatus 1000 according to an embodiment of the present disclosure, the cabinet cover 200 may have a hook protrusion 210 that protrudes rearward from the circumference of a second through hole 202 provided lower than the center of the first through hole 201. In this case, the control panel 300 may be fastened to the hook protrusion 210 and coupled to the inner surface of the cabinet cover 200.

That is, in the laundry treating apparatus 1000 according to the present embodiment, since the control panel 300 is fastened to the hook protrusion 210 protruding from the second through hole 202 provided in the cabinet cover 200, manufacturing efficiency can be improved by forming the hook protrusion 210 for fastening the control panel 300 at the time of forming the second through hole 202.

In the laundry treating apparatus 1000 according to an embodiment of the present disclosure, the hook protrusion 210 may have a hook hole 211 penetrating the hook protrusion in the longitudinal direction thereof. In this case, the coating guide 330 may be fastened when the hook 370 provided at the lower end thereof is inserted into the hook hole 211.

That is, in the laundry treating apparatus 1000 according to the present embodiment, since the hook 370 at the lower end portion of the coating guide 330 is inserted into and fastened to the hook hole 211 penetrating the hook protrusion 210 in the longitudinal direction, the control panel 300 can be easily and stably fastened to the hook protrusion 210.

In the laundry treating apparatus 1000 according to an embodiment of the present disclosure, the upper end portion of the coating guide 330 may be screwed to the inner surface of the cabinet cover 200.

That is, in the laundry treating apparatus 1000 according to the present embodiment, since the upper end portion of the coating guide 330 is screwed to the inner surface of the cabinet cover 200, the coupled state between the cabinet cover 200 and the control panel 300 can be stably maintained.

The laundry treating apparatus 1000 according to an embodiment of the present disclosure may further include a control button 500 installed inside the cabinet cover 200 and partially exposed outside through the second through hole 202 to be brought into contact with the control panel 300 when pressed by a user.

That is, in the laundry treating apparatus 1000 according to the present embodiment, since the control button 500 is installed inside the cabinet cover 200 and the control button 500 is partially exposed outside through the second through hole 202 in the cabinet cover 200, input of control signals for which an intuitive operation, such as a power on/off signal and a start/stop operation signal, is desirable can be performed smoothly.

In the laundry treating apparatus 1000 according to an embodiment of the present disclosure, a pair of second through holes 202 and control buttons 500 may each be arranged symmetrically on opposite sides of the control panel 300.

That is, in the laundry treating apparatus 1000 according to the present embodiment, since the second through holes 202 and the control buttons 500 are each arranged symmetrically on the opposite sides of the control panel 300, a plurality of control signals can be input through the control buttons 500 and a balance in the exterior design can be achieved.

In the laundry treating apparatus 1000 according to an embodiment of the present disclosure, the hook protrusions 210 may be provided at the second through holes 202, respectively. In this case, the control panel 300 may be fastened to both the respective hook protrusions 210.

That is, in the laundry treating apparatus 1000 according to the present embodiment, since the control panel 300 is fastened to both the respective hook protrusions 210 provided at the pair of second through holes 202, respectively, the control panel 300 can be fastened to the hook protrusions 210 while maintaining balance.

The laundry treating apparatus 1000 according to an embodiment of the present disclosure may further include a wireless communication part 600 installed inside the cabinet cover 200 to be capable of transmitting and receiving wireless signals to and from the outside. In this case, the wireless communication part 600 may be installed on the inner surface of the cabinet cover 200 while being coupled to the bottom of the control panel 300.

That is, in the laundry treating apparatus 1000 according to the present embodiment, since the wireless communication part 600 is installed on the inner surface of the cabinet cover 200 in the state of being coupled to the bottom of the control panel 300, main components can be efficiently arranged in the internal space of the cabinet cover 200, and the control panel 300 can be disposed higher in the front upper end portion of the cabinet cover 200.

Figure 10:
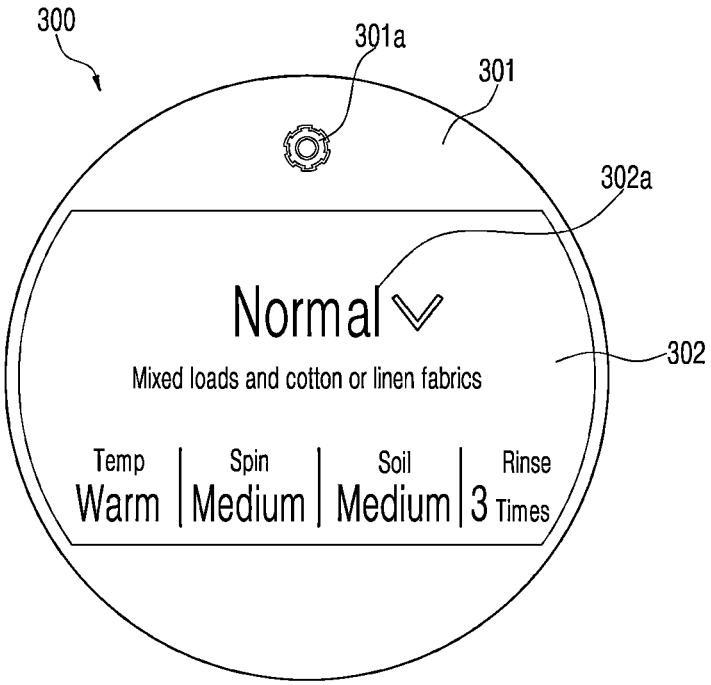
FIG. 10 is a view illustrating a fixed UI section and a variable UI section of the control panel in the laundry treating apparatus according to an embodiment of the present disclosure.
Figure 11A:
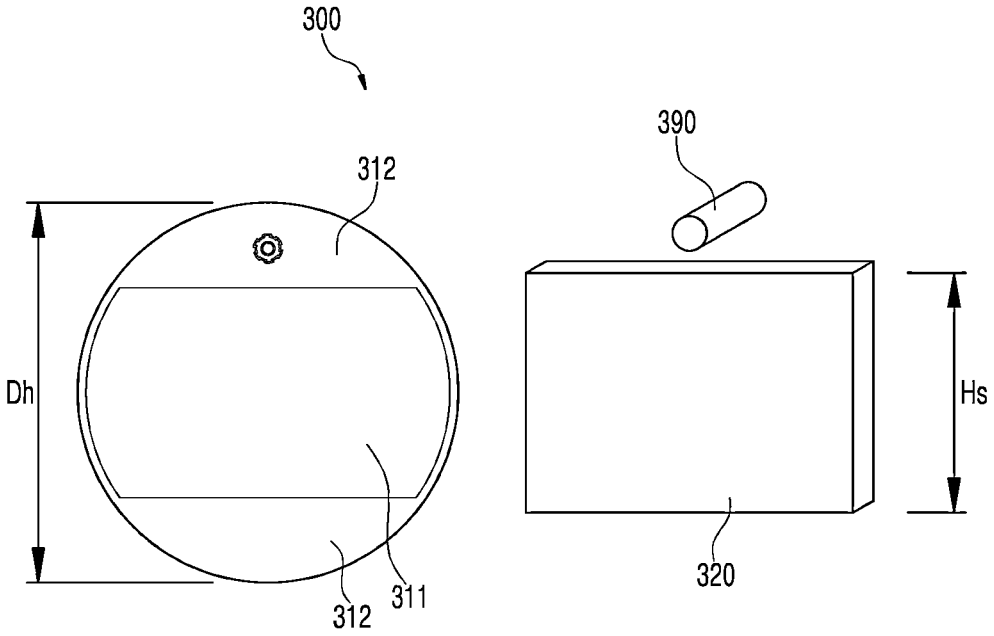
FIG. 11A is a view illustrating, by way of an example, a transmissive area and a non-transmissive area of the control panel in the laundry treating apparatus according to an embodiment of the present disclosure.
Figure 11B:
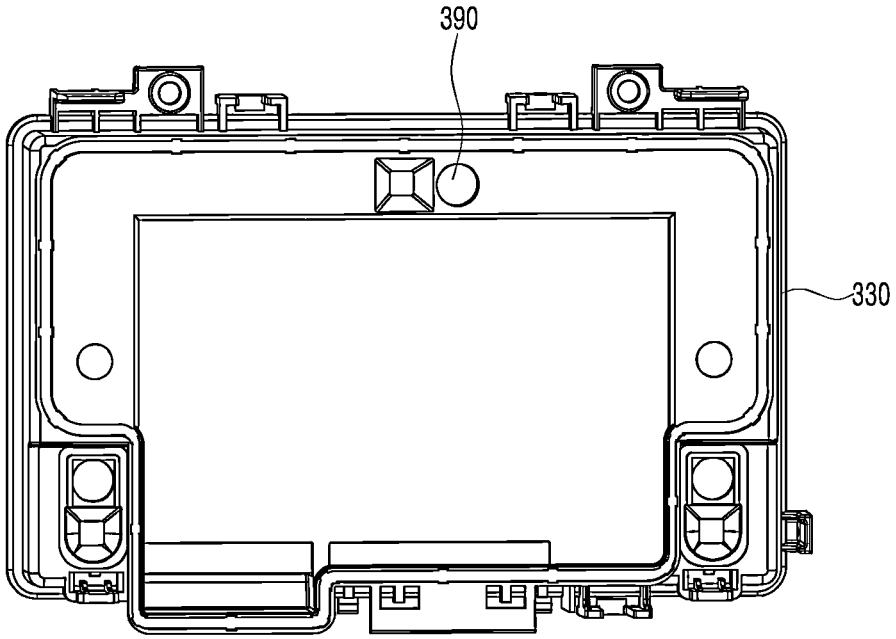
FIGS. 11B and 11C are views illustrating, by way of an example, a button rod contact type of the control panel in the laundry treating apparatus according to an embodiment of the present disclosure.
Figure 11C:
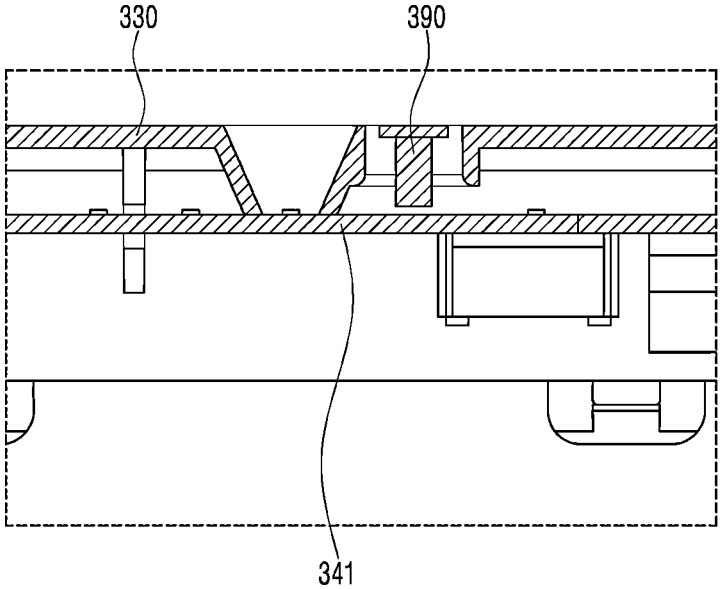
Figure 12:
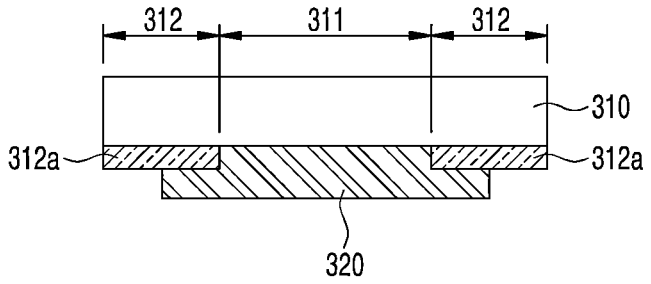
FIGS. 12 to 14 are views illustrating a structure that provides a transmissive area and a non-transmissive area of the control panel in the laundry treating apparatus according to an embodiment of the present disclosure.
Figure 13:
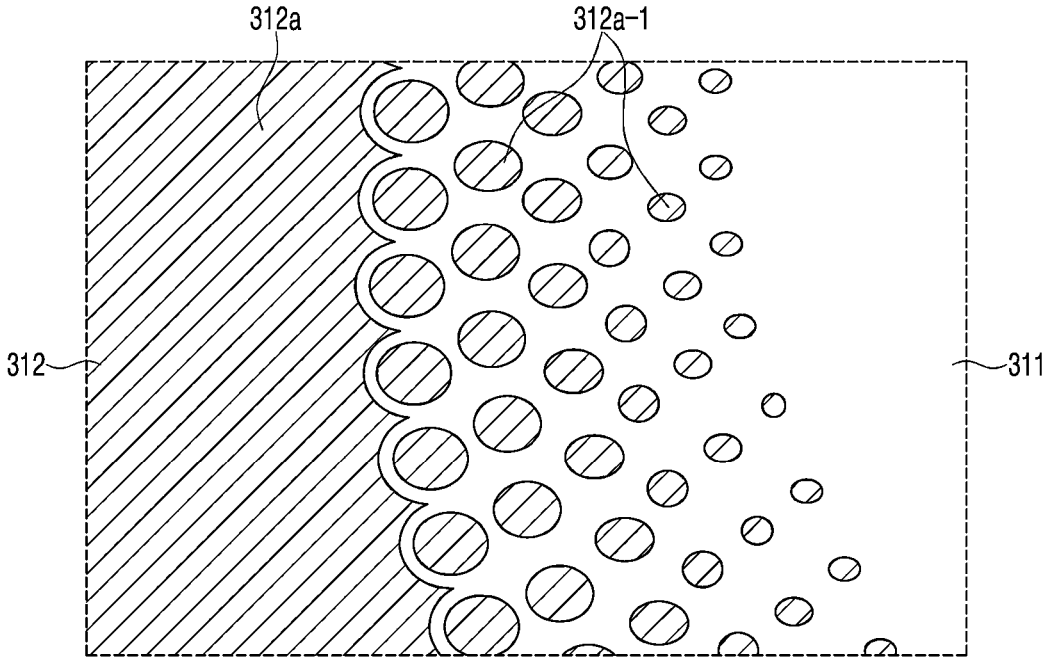
Figure 14:
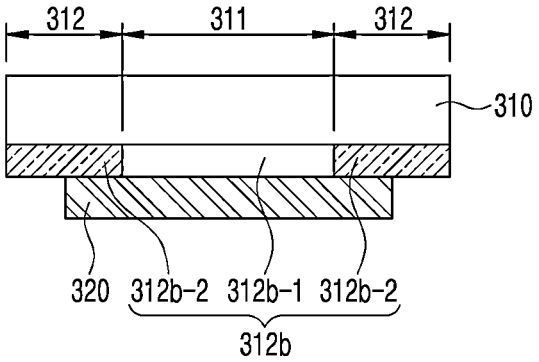

FIG. 10 is a view illustrating, by way of an example, a fixed UI section 301 and a variable UI section 302 of the control panel 300 in the laundry treating apparatus 1000 according to an embodiment of the present disclosure. FIG. 11A is a view illustrating, by way of an example, a transmissive area 311 and a non-transmissive area 312 of the control panel 300 in the laundry treating apparatus 1000 according to an embodiment of the present disclosure. FIGS. 11B and 11C are views illustrating a button rod 390 contact type of the control panel 300 in the laundry treating apparatus according to an embodiment of the present disclosure. FIGS. 12 to 14 are views illustrating the structure of providing the transmissive area 311 and the non-transmissive area 312 of the control panel 300 in the laundry treating apparatus 1000 according to an embodiment of the present disclosure.

In the laundry treating apparatus 1000 according to an embodiment of the present disclosure, the control panel 300 may include a fixed UI section 301 in which a first control UI 301*a*, of which the display is fixed, is disposed, and a variable UI section 302 in which a second control UI 302*a*, of which the display-on/off and type are variable, is disposed.

That is, in the laundry treating apparatus 1000 according to the present embodiment, since the fixed UI section 301 and the variable UI section 302 provided in the control panel 300 are arranged according to UI characteristics, a user may more conveniently input control signals for processing operations.

In the laundry treating apparatus 1000 according to an embodiment of the present disclosure, a portion of an area of the window 310 corresponding to the first through hole 201 may be provided as a transmissive area 311, and the remaining portion is provided as a non-transmissive area 312. In this case, the touch screen 320 may be coupled to the rear surface of the window 310 and perform display through the transmissive area 311.

That is, in the laundry treating apparatus 1000 according to the present embodiment, since the touch screen 320 is displayed through the transmissive area 311 provided in a portion of the window 310, and the remaining portion of the window 310 is provided as a non-transmissive area 312, various exterior designs may be implemented regardless of the shape of the touch screen 320.

The laundry treating apparatus 1000 according to an embodiment of the present disclosure may include a main body 100, a cabinet cover 200, a control panel 300, and a control button 500.

The main body 100 is a part that accommodates laundry to perform processing operations for the laundry, and is capable of performing at least one of washing, rinsing, spin-drying, and drying.

The cabinet cover 200 is a part that covers the main body 100 to form an exterior and has a first through hole 201 provided in the front upper portion thereof, and a second through hole 202 provided lower than the center of the first through hole 201.

That is, as described above, the first through hole 201 may be provided in the cabinet cover 200 to allow a portion of the control panel 300 to be exposed outside. In addition, the second through hole 202 may be provided lower than the center of the first through hole 201, so that a control button 500 can be disposed therein.

The control panel 300 is a part that is installed inside the cabinet cover 200 and partially exposed outside through the first through hole 201 so that control signals for processing operations can be input by a user.

The control button 500 is a part that is installed inside the cabinet cover 200 and partially exposed outside through the second through hole 202 to be capable of coming into contact with the control panel 300 when pressed by a user.

That is, when the control button 500 is installed inside the cabinet cover 200, only the portion for a user to operate may be exposed outside through the second through hole 202. Accordingly, the user may input specific control signals associated with the control button 500 to the laundry treating apparatus 1000 by pressing the portion of the control button 500 exposed outside the cabinet cover 200.

In this case, the specific control signals associated with the control button 500 are essentially used due to the characteristics thereof, such as a power on/off signal and an operation start/stop signal, but the types thereof do not need to be changed. It may be desirable to arrange the control signals such that the user can intuitively operate the control signals.

That is, it may be desirable to arrange the signals such as a power on/off signal and an operation start/stop signal such that a user can operate the signals through the control button 500, which is fixedly installed separately from the control panel 300.

Therefore, when the user presses the control button 500, the portions of the control buttons 500 disposed inside the cabinet cover 200 come into contact with the control panel 300 so that signals such as a power on/off signal and an operation start/stop signal can be input to the controller 800.

Meanwhile, when the user presses the control button 500, the portion of the control button 500 disposed inside the cabinet cover 200 may not come into contact with the control panel 300, but signals such as turn on/off and operation start/stop may be input to the controller 800 through a separate signal transmission path.

In the laundry treating apparatus 1000 according to an embodiment of the present disclosure, the cabinet cover 200 may have a hook protrusion 210 protruding rearward from the circumference of the second through hole 202, and the control panel 300 may be coupled to the inner surface of the cabinet cover 200 while being fastened to the hook protrusion 210.

That is, the circumference of the second through hole 202 provided through the cabinet cover 200 may be partially bent toward the rear side to provide the hook protrusion 210. In particular, the hook protrusion 210 is not a separate member coupled to the second through hole 202 of the cabinet cover 200, but may be formed by bending integrally with the second through hole 202 which is formed when the cabinet cover 200 is manufactured as a sheet metal product.

In addition, the control panel 300 may be configured in a structure that is supported by being fastened to the hook protrusion 210 provided integrally with the circumference of the second through hole 202.

In this way, in the laundry treating apparatus 1000 according to the present embodiment, since the control panel 300 is fastened to the hook protrusion 210 protruding from the second through hole 202 provided in the cabinet cover 200, manufacturing efficiency can be improved by forming the hook protrusion 210 for fastening the control panel 300 at the time of forming the second through hole 202.

In the laundry treating apparatus 1000 according to an embodiment of the present disclosure, the hook hole 211 may penetrate the hook protrusion 210 in the longitudinal direction thereof, and the control panel 300 may be fastened when the hook 370 is inserted into the hook hole 211.

That is, as described above, the hook protrusion 210 may have a shape protruding rearward from the circumference of the second through hole 202, and the hook hole 211 may be provided in a shape penetrating the hook protrusion 210 in the longitudinal direction.

In addition, the hook 370 may protrude at the lower end portion of the control panels 300, and the hook 370 may be inserted into and fastened to the hook hole 211 having the shape penetrating the hook protrusion in the longitudinal direction.

In this case, since the second through hole 202 is provided lower than the center of the first through hole 201, the hook 370 at the lower end portion of the control panel 300 may be easily fastened to the hook protrusion 210 protruding rearward from the circumference of the second through hole 202.

Accordingly, when the hook 370 is inserted into and fastened to the hook holes 211, the forward and rearward displacement of the control panel 300 can be limited by the hook protrusion 210. In addition, a portion of the control panel 300 may be seated on the upper surface of the hook protrusion 210 so that the upward and downward displacement of the control panel 300 can also be limited to a certain extent.

In this way, in the laundry treating apparatus 1000 according to the present embodiment, since the hook 370 at the lower end portion of the control panel 300 is inserted into and fastened to the hook hole 211 penetrating the hook protrusions 210 in the longitudinal direction, the control panel 300 can be easily and stably fastened to the hook protrusion 210.

In the laundry treating apparatus 1000 according to an embodiment of the present disclosure, the upper end portion of the control panel 300 may be screwed to the inner surface of the cabinet cover 200.

As described above, even when the hook 370 at the lower end portion of the control panel 300 is fastened to the hook protrusion 210 to be limited in the displacement, a relatively large displacement may occur at the upper end portion of the control panel 300.

Therefore, in addition to fastening the lower end portion of the control panel 300, it may be desirable to fasten the upper end portion of the control panel 300 to the cabinet cover 200 so that the overall displacement of the control panel 300 is limited. To this end, the upper end portion of the control panel 300 may be fastened to the cabinet cover 200 through at least one screw 380.

In this way, in the laundry treating apparatus 1000 according to the present embodiment, since the upper end portion of the control panel 300 is screwed to the inner surface of the cabinet cover 200, the coupled state between the cabinet cover 200 and the control panel 300 can be stably maintained.

In the laundry treating apparatus 1000 according to an embodiment of the present disclosure, a pair of second through holes 202 and control buttons 500 may be arranged symmetrically on opposite sides of the control panel 300.

That is, on the front exterior of the laundry treating apparatus 1000, second through holes 202 may be provided symmetrically on the left and right sides of the control panel 300, respectively. In addition, a control button 500 may be disposed in each of the second through holes 202.

In this case, one control button 500 may be associated with a power on/off signal, and another control button 500 may be associated with an operation start/stop signal.

In this way, in the laundry treating apparatus 1000 according to the present embodiment, since the second through holes 202 and the control buttons 500 are each arranged as a symmetrical pair on the opposite sides of the control panel 300, a plurality of control signals can be input through the control buttons 500 and a balance in the exterior design can be achieved.

In the laundry treating apparatus 1000 according to an embodiment of the present disclosure, the hook protrusions 210 may be provided at the second through holes 202, respectively, and the control panel 300 may be fastened to both the respective hook protrusions 210.

That is, on the front exterior of the laundry treating apparatus 1000, second through holes 202 may be provided symmetrically on the left and right of the control panel 300, and hook protrusions 210 may be provided for the second through holes 202, respectively. In addition, a pair of hooks 370 may be provided at the lower end portion of the control panel 300 so that the hooks 370 can be fastened to the hook protrusions 210, respectively.

When only one hook 370 is fastened to the hook protrusion 210, displacement in the forward and rearward directions and upward and downward directions may be limited to a certain extent, but when the control panel 300 is not balanced on the left and right with respect to the hook 370, there is a risk that rotational displacement may occur.

Therefore, it may be desirable to provide a pair of hooks 370 at the lower end portion of the control panel 300 so that the hooks are fastened together to the hook protrusions 210 provided at the pair of second through holes 202, respectively.

In this way, in the laundry treating apparatus 1000 according to the present embodiment, since the control panel 300 is fastened to both the respective hook protrusions 210 provided at the pair of second through holes 202, respectively, the control panel 300 can be fastened to the hook protrusions 210 while maintaining balance.

The laundry treating apparatus 1000 according to an embodiment of the present disclosure may include a main body 100, a cabinet cover 200, a control panel 300, and a wireless communication part 600. In this case, the wireless communication part 600 may be installed on the inner surface of the cabinet cover 200 while being coupled to the bottom of the control panel 300.

The wireless communication part 600 is a part that is installed inside the cabinet cover 200 and configured to transmit and receive wireless signals to the outside. The wireless communication part may be configured to receive signals, which are wirelessly input from outside the laundry treating apparatus 1000, and to transmit the signals to the controller 800, or may be configured to wirelessly transmit signals, which are output from the controller 800, to outside the laundry treating apparatus 1000.

In this case, the wireless communication part 600 may include at least one of Wi-Fi, Bluetooth, and RF communication modules. For example, the laundry treating apparatus 1000 may be configured to perform wireless communication with a user's mobile terminal via a Wi-Fi communication module or a Bluetooth communication module. As another example, the laundry treating apparatus 1000 may be configured to perform wireless communication with another home appliance (e.g., another separate laundry treating apparatus 1000) via an RF communication module.

The wireless communication part 600 may be disposed in the internal space of the cabinet cover 200. However, it may be desirable for the wireless communication part to be disposed as close to the external portion of the cabinet cover 200 as possible in the internal space of the cabinet cover 200 in order to minimize a decrease in wireless communication efficiency.

In particular, when the cabinet cover 200 is made of a metal material, in order ensure that the wireless communication part 600 performs wireless communication smoothly, it may be desirable for the wireless communication part 600 to be disposed adjacent to the first through hole 201 or the second through hole 202 in the cabinet cover 200.

In addition, since it is more efficient for the wireless communication part 600 to be disposed adjacent to the control panel 300 and the printed circuit board 341, it may be more desirable for the wireless communication part 600 to be installed together with the control panel 300.

Therefore, the wireless communication part 600 may be installed on the inner surface of the cabinet cover 200 in the state of being coupled to the control panel 300, rather than being installed separately from the control panel 300.

Meanwhile, since the overall height of the laundry treating apparatus 1000 is generally less than the height of the user's eyes, in order for the user to more easily check and operate the control panel 300, it may be desirable for the control panel 300 to be disposed as high as possible in the front upper end portion of the cabinet cover 200.

Accordingly, the first through hole 201 configured to expose a portion of the control panel 300 outside the cabinet cover 200 also needs to be disposed as high as possible in the front upper end portion of the cabinet cover 200.

In this case, when a separate main component is disposed on top of the control panel 300, it may be difficult to dispose the control panel 300 and the first through hole 201 as high as possible in the front upper end portion of the cabinet cover 200.

Accordingly, when the wireless communication part 600 coupled and installed on the control panel 300 is coupled to the bottom of the control panel 300, efficient arrangement of the wireless communication part 600 and optimal arrangement of the control panel 300 may be achieved.

In this way, in the laundry treating apparatus 1000 according to the present embodiment, since the wireless communication part 600 is installed on the inner surface of the cabinet cover 200 in the state of being coupled to the bottom of the control panel 300, main components can be efficiently arranged in the internal space of the cabinet cover 200, and the control panel 300 can be disposed higher in the front upper end portion of the cabinet cover 200.

The laundry treating apparatus 1000 according to an embodiment of the present disclosure may further include a sound output unit 700 that is installed inside the cabinet cover 200 and configured to output sound signals for processing operations. In this case, the sound output unit 700 may be installed on the inner surface of the cabinet cover 200 while being coupled to a side surface of the control panel 300.

The sound output unit 700 is a component that guides the user to specific matters or draws the user's attention to the specific matters by an auditory sound signal, such as a buzzer or speaker, and may be configured in various ways according to need.

The sound output unit 700 may be disposed in the internal space of the cabinet cover 200. However, it may be desirable for the sound output unit to be disposed as close to the external portion of the cabinet cover 200 as possible in the internal space of the cabinet cover 200 in order to insure that sound signals are smoothly transmitted to the user.

In addition, since it is also more efficient for the sound output unit 700 to be disposed adjacent to the control panel 300 and the printed circuit board 341, it may be more desirable for the sound output unit 700 to be installed together with the control panel 300.

Therefore, the sound output unit 700 may also be installed on the inner surface of the cabinet cover 200 in the state of being coupled to the control panel 300, rather than being installed separately from the control panel 300.

However, as described above, it is not desirable for the sound output unit 700 to be coupled to the top of the control panel 300. In addition, in order to minimize interference with the wireless communication part 600 coupled to the bottom of the control panel 300, it may be desirable for the sound output unit 700 to be coupled to a side surface of the control panel 300.

As described above, in the laundry treating apparatus 1000 according to the present embodiment, since the sound output unit 700 is installed on the inner surface of the cabinet cover 200 in the state of being coupled to the side surface of the control panel 300, the sound output unit 700 may also be arranged to match the most efficient arrangement of the control panel 300.

Meanwhile, regarding the laundry treating apparatus 1000 according to the present embodiment, the configuration in which the wireless communication part 600 and the sound output unit 700 are disposed at the bottom of the control panel 300 and on the side surface of the control panel 300, respectively, has been described, but the laundry treating apparatus is not necessarily limited thereto. If necessary, the wireless communication part 600 and the sound output unit 700 may be disposed on the side surface of the control panel 300 and at the bottom of the control panel 300, respectively.

In addition, within the limit of preventing the wireless communication part 600 and the sound output unit 700 from interfering with each other, both the wireless communication part 600 and the sound output unit 700 may be disposed at the bottom of the control panel 300, or disposed on the side surface of the control panel 300.

In the laundry treating apparatus 1000 according to an embodiment of the present disclosure, the control panel 300 may include a window 310, a touch screen 320, and a coating guide 330 so that the control panel 300 directly coupled inside the cabinet cover 200 can be easily and stably installed.

In this case, the wireless communication part 600 may be coupled to the bottom of the coating guide 330, and the sound output unit 700 may be coupled to the side surface of the coating guide 330.

As described above, the coating guide 330 is a part that supports the touch screen 320. In view of the fact that the coating guide 330 has a certain level of rigidity in the control panel 300 and does not have high functional sensitivity, the coating guide 330 may be most desirable for coupling with other components.

Therefore, it may be desirable to couple the wireless communication part 600 to the bottom of the coating guide 330 in the control panel 300 and to couple the sound output unit 700 to the side surface of the coating guide 330.

In this way, in the laundry treating apparatus 1000 according to the present embodiment, since the wireless communication part 600 and the sound output unit 700 are coupled to the bottom and the side surface of the coating guide 330, respectively, the communication part 600 and the sound output unit 700 can be coupled to the most desirable portions in the control panel 300.

The laundry treating apparatus 1000 according to an embodiment of the present disclosure may include a main body 100, a cabinet cover 200, and a control panel 300. In this case, the control panel 300 may include a fixed UI section 301 and a variable UI section 302.

The control panel 300 is a part that is exposed outside the cabinet cover 200 so that the user can input control signals for the laundry treating apparatus 1000. The user may input operating signals for each component of the laundry treating apparatus 1000 by operating the control panel 300.

In this case, UIs are disposed on the control panel 300, so that the user can may operate the UIs disposed on the control panel 300 to input operating signals for each component of the laundry treating apparatus 1000.

On the other hand, among the UIs, there may be a UI that is essentially used due to its characteristics, but whose display does not need to be changed. In addition, among the UIs, there may be a UI that needs to be used while varying to various types due to its characteristics.

In this way, since the UIs disposed on the control panel 300 are operated differently by the user depending on the characteristics thereof, it may be desirable to arrange respective UIs separately in consideration of the characteristics thereof so that the user can use the UIs more conveniently.

To this end, a first control UI 301*a*, of which the display is fixed, may be disposed in the fixed UI section 301. In this case, the first control UI 301*a* (e.g., a setting UI) is essentially used due to its characteristics, but its display does not need to be changed. Therefore, the user may recognize that the first control UI is always disposed at that on the control panel 300.

In addition, a second control UI 302*a* of which the status and type are variable may be disposed in the variable UI section 302. In this case, the second control UI 302*a* needs to be used while varying to various types due to its characteristics, and the user needs to operate the second control UI while checking the status and type of the currently implemented UI.

As described above, in the laundry treating apparatus 1000 according to the present embodiment, since the fixed UI section 301 and the variable UI section 302 provided in the control panel 300 are arranged according to UI characteristics, the user may more conveniently input control signals for processing operations.

In the laundry treating apparatus 1000 according to an embodiment of the present disclosure, operation signals for the first control UI 301*a* may be input to the fixed UI section 301 by a button rod contact type.

In this case, the button rod contact type may refer to a contact type with a structure in which, when a user operates the fixed UI section 301, a separate button rod 390 capable of connecting electrical signals moves and transmits the corresponding signals to the control box or controller 800.

That is, when the user touches the fixed UI section 301 by touching, pressing, or the like, the button rod 390 arranged to be brought into brought into a corresponding portion at one end is pressed and pushed rearward. In this case, as the other end of the button rod 390 is brought into contact with the control box or controller 800, an electrical signal may be connected, and as a result, the control signal that the user wishes to input may be transmitted to the controller 800.

As described above, the first control UI 301*a* disposed in the fixed UI section 301 may be controlled by a simple operation by the user without the need to change the display. Therefore, the button rod contact type that is relatively easy to operate may be desirable for the first control UI.

In this way, in the laundry treating apparatus 1000 according to the present embodiment, since the fixed UI section 301 is operated by the button rod contact type, the user may easily operate the fixed UI section 301, of which the display is fixed.

In the laundry treating apparatus 1000 according to an embodiment of the present disclosure, operation signals for the second control UI 302*a* may be input to the variable UI section 302 by a touch type.

In this case, the touch type may refer to a contact type with a structure in which, when a touch object such as a human hand or an object (e.g., a stylus pen) touches the second control UI 302*a* appearing in the variable UI section 302 through a separate touch sensor or the like, a corresponding signal can be transmitted to the control box or the controller 800.

As described above, in view of the fact that the second control UI 302*a* disposed in the variable UI section 302 needs to be used while varying to various types due to its characteristics, the touch type, which allows the user to operate the UI while checking the status and type of the UI that is being implemented by the user, may be desirable for the second control UI.

In particular, since the type of the second control UI 302*a* also varies in the variable UI section 302, it may be convenient to allow various types of UIs to vary through touching on a screen of a certain area.

In this way, in the laundry treating apparatus 1000 according to the present embodiment, since the variable UI section 302 is operated by a touch type, the user may effectively operate the variable UI section 302 of which the display-on/off and type vary.

Meanwhile, the first control UI 301*a* may include at least one of a power UI on which power-on/power-off of the laundry treating apparatus 1000 can be selected, and an operation UI on which turn-on/turn-off of the operation of the laundry treating apparatus 1000 can be selected, and a setting UI on which the settings of the laundry treating apparatus 1000 can be selected.

The second control UI 302*a* is an operation UI on which the operation type of the laundry treating apparatus 1000 can be selected, a laundry UI on which the type of laundry accommodated in the laundry treating apparatus 1000 can be selected, and a time UI on which the operating time of the laundry treating apparatus 1000 can be selected.

The operation UI is used to set the process to be performed for laundry in the laundry treating apparatus 1000. It is necessary to operate the operation UI while checking the status and type of the UI that is currently being implemented.

Similarly, the laundry UI is used to select the type of laundry to be processed in the laundry treating apparatus 1000 so that optimal processing can be performed accordingly. It is necessary to operate the laundry UI while checking the status and type of a UI that is currently being implemented.

In addition, similarly, the time UI is used to set the time for processing laundry in the laundry treating apparatus 1000. It is also necessary to operate the time UI while checking the status and type of a UI that is currently being implemented.

Therefore, it may be desirable to dispose the operation UI, the laundry UI, and the time UI in the variable UI section 302 to be variable in terms of display-on/off and type.

In the laundry treating apparatus 1000 according to an embodiment of the present disclosure, the control panel 300 may include a window 310, a touch screen 320, and a coating guide 330 so that the control panel 300 directly coupled inside the cabinet cover 200 can be easily and stably installed.

In this case, the touch screen 320 may be disposed in the variable UI section 302.

When the touch screen 320 is a screen configured to: determine, when a touch object such as a human hand or an object (e.g., a stylus pen) touches a character displayed on the screen or a specific location on the screen, the location; and allow an input material to be received directly therefrom so specific processing can be executed by stored software. The controller 800 may change the display-on/off and type to correspond to the type of the touch object touching the touch screen 320.

As described above, in the laundry treating apparatus 1000 according to the present embodiment, since the touch screen 320 is disposed in the variable UI section 302, the variable UI section 302 in which display-on/off and type vary can be smoothly implemented on the touch screen 320.

In the laundry treating apparatus 1000 according to an embodiment of the present disclosure, the first through hole 201 may be provided as a circular open surface. In this case, the touch screen 320 may be fabricated in a quadrilateral shape with a height Hs that is relatively smaller than the diameter Dh of the first through hole 201.

That is, in the laundry treating apparatus 1000 according to the present embodiment, since the touch screen 320 has a height relatively smaller than the diameter of the first through hole 201 provided in a circular shape, it may be possible to implement a circular display on the exterior design even when the touch screen 320 is not fabricated in a relatively expensive circular structure.

In the laundry treating apparatus 1000 according to an embodiment of the present disclosure, a portion of an area of the window 310 corresponding to the first through hole 201 may be provided as a transmissive area 311, and the remaining portion is provided as a non-transmissive area 312. In this case, the touch screen 320 may be coupled to the rear surface of the window 310 and perform display through the transmissive area 311.

That is, in the laundry treating apparatus 1000 according to the present embodiment, since the touch screen 320 is displayed through the transmissive area 311 provided in a portion of the window 310, and the remaining portion of the window 310 is provided as a non-transmissive area 312, various exterior designs may be implemented regardless of the shape of the touch screen 320.

The laundry treating apparatus 1000 according to an embodiment of the present disclosure may include a main body 100, a cabinet cover 200, and a control panel 300. In this case, the control panel 300 may include a window 310 and a touch screen 320.

A portion of an area of the window 310 corresponding to the first through hole 201 may be provided as a transmissive area 311 and the remaining portion may be provided as a non-transmissive area 312. In this case, the touch screen 320 may be coupled to the rear surface of the window 310 and perform display through the transmissive area 311.

The transmissive area 311 refers to an area configured to transmit at least part of the light such that the opposite side or the inside is visible. Accordingly, the transmissive area 311 may be a concept that includes a semi-transmissive area.

Specifically, as illustrated in FIG. 12, the window 310 may be made of a transmissive material. That is, the window 310 may be made of a transmissive glass material or a synthetic resin material.

A shield layer 312*a* may be disposed on a portion of the window 310 to provide a non-transmissive area 312. In this case, the shield layer 312*a* may be disposed on the front or rear surface of the window 310.

In FIG. 12, ink is printed on the rear surface of the window 310 to form the shield layer 312*a*. The ink may contain pigments having a specific color group (e.g., black, white, and blue).

In this case, as a method of forming the shield layer 312*a*, various printing techniques such as screen printing (using a mesh formed of silk, nylon, tetron, stainless steel, or the like), offset printing, and transfer printing may be applied.

The shield layer 312*a* is not disposed in the transmissive area 311. That is, the transmissive area 311 may be a transparent portion that is not covered by the shield layer 312*a* and remains as a transmissive window 310.

A touch screen 320 may be coupled to the rear surface of the window 310 corresponding to the transmissive area 311. The touch screen 320 may be disposed to completely cover the transmissive area 311 to detect a touch input to the transmissive area 311.

The touch screen 320 may be fabricated to have a size larger than the transmissive area 311, and in this case, the touch screen 320 may be configured to cover a portion of the shield layer 312*a* that defines the transmissive area 311.

As illustrated in FIG. 13, the shield layer 312*a* defining the transmissive area 311 of the window 310 may be configured such that its transparency gradually changes toward the transmissive area 311.

For example, the non-transmissive area 312 around the transmissive area 311 may be configured to gradually become transparent toward the transmissive area 311. To this end, the shield layer 312*a* may include a plurality of shield dots 312*a*-1 provided around the transmissive area, and the plurality of shield dots 312*a*-1 may be provided to have a lower density toward the transmissive area 311.

By blurring the boundary of the transmissive area 311 through this halftone technique, a visual transition from the non-transmissive area 312 to the transmissive area 311 can be naturally achieved.

In addition, as illustrated in FIG. 14, unlike the above embodiment in which the shield layer 312*a* is printed on the rear surface of the window 310, a film 312*b* may be bonded to the rear surface of the window 310 to provide the non-transmissive area 312.

The film 312*b* may include a non-transmissive portion 312*b*-2 corresponding to the non-transmissive area and a transmissive portion 312*b*-1 corresponding to the transmissive area 311. The non-transmissive portion 312*b*-2 is provided to surround the transmissive portion 312*b*-1, and the transmissive portion 312*b*-1 may be partitioned by the non-transmissive portion 312*b*-2.

Here, the portion corresponding to the non-transmissive portion 312*b*-2 may function as a shield layer 312*a* that makes the window 310 opaque, thereby forming the non-transmissive area 312. The portion corresponding to the transmissive portion 312*b*-1 may form the transmissive area 311 together with the transmissive window 310.

A touch screen 320 may be coupled to the rear surface of the film 312*b* corresponding to the transmissive portion 312*b*-1. The touch screen 320 may be disposed to completely cover the transmissive area 311 to detect a touch input to the transmissive area 311.

The touch screen 320 may be provided in a size larger than the transmissive area 311, and in this case, the touch screen 320 may be configured to cover a portion of the non-transmissive portion 312*b*-2 that defines the transmissive portion 312*b*-1.

In this way, in the laundry treating apparatus 1000 according to the present embodiment, since the touch screen 320 is displayed through the transmissive area 311 provided in a portion of the window 310, and the remaining portion of the window 310 is provided as a non-transmissive area 312, various exterior designs may be implemented regardless of the shape of the touch screen 320.

In the laundry treating apparatus 1000 according to an embodiment of the present disclosure, the touch screen 320 may be fabricated in a shape having a flat surface relatively smaller than the open surface of the first through hole 201, and in the area corresponding to the first through hole 201 in the window 310, the portion in which the touch screen 320 does not perform display may be provided as a non-transmissive area 312.

Depending on the exterior design of the laundry treating apparatus 1000, the portion through which the control panel 300 is externally exposed (i.e., the first through hole 201) may have various shapes. However, even when the shape of the first through hole 201 is provided in various ways in terms of a design, if the planar shape of the touch screen 320 for display does not match the shape of the first through hole 201, there is a risk that aesthetics may be deteriorated.

Therefore, in order to implement various exterior designs without being limited by the planar shape of the touch screen 320, it may be desirable to cover the portion of the first through hole 201 where the touch screen 320 is not displayed by the non-transmissive area 312 of the window 310.

In this way, in the laundry treating apparatus 1000 according to the present embodiment, the first through hole 201 is opened relatively larger than the touch screen 320, and the portion of the through hole 201 where the touch screen 320 is not displayed is covered by the non-transmissive area 312 of the window 310. Therefore, it is possible to implement a design in which only the touch screen 320 is displayed even when the open shape of the first through hole 201 does not correspond to the planar shape of the touch screen 320.

In the laundry treating apparatus 1000 according to an embodiment of the present disclosure, the first through hole 201 may be provided as a circular open surface, and the touch screen 320 be fabricated in a quadrilateral shape with a height Hs that is relatively smaller than the diameter Dh of the first through hole 201.

Here, the circular shape may include a true circular shape, an oval shape, or a round shape which is at least partially rounded.

The circular touch screen 320 may be more expensive than the widely used quadrilateral touch screen 320, and since it is difficult to determine the exact installation location due to its shape, assembly defects may occur frequently.

However, according to the structure according to the present embodiment, it is possible to provide a control panel 300 that appears circular to the user while using the quadrilateral touch screen 320 that is inexpensive and can be assembled in the correct position.

Since the transmissive area 311 is surrounded by the non-transmissive area 312, visual information output from a portion of the touch screen 320 that does not correspond to the transmissive area 311 is invisible to the user. Considering this, visual information may not be output on a portion of the touch screen 320 that does not correspond to the transmissive area 311.

In this way, in the laundry treating apparatus 1000 according to the present embodiment, since the touch screen 320 has a height relatively smaller than the diameter of the first through hole 201 provided in a circular shape, it may be possible to implement a circular display on the exterior design even when the touch screen 320 is not fabricated in a relatively expensive circular structure.

In the laundry treating apparatus 1000 according to an embodiment of the present disclosure, the control panel 300 may include a fixed UI section 301 in which a first control UI 301*a*, of which the display is fixed, is disposed, and a variable UI section 302 in which a second control UI 302*a*, of which the display-on/off and type are variable, is disposed. Therefore, control signals for processing operations can be more conveniently input by the user.

In this case, the fixed UI section 301 may be provided as a non-transmissive area 312, and the variable UI section 302 may be provided as the transmissive area 311.

As described above, since the touch screen 320 is disposed in the variable UI section 302, the variable UI section 302 needs to be formed as a transmissive area 311. In contrast, it may be desirable to provide the fixed UI section 301 as a non-transmissive area 312 and to dispose only UIs that are relatively simple to operate in the fixed UI section.

In this way, in the laundry treating apparatus 1000 according to the present embodiment, since the fixed UI section 301 and the variable UI section 302 of the control panel 300 are provided as the non-transmissive area 312 and the transmissive area 311, respectively, the variable UI section 302, of which the display-on/off and type vary, may be implemented on the touch screen 320.

In the laundry treating apparatus 1000 according to an embodiment of the present disclosure, in the fixed UI section 301, an operation signal for the first control UI 301*a* is input by the button rod contact type, so that the user can easily operate the fixed UI section 301, of which the display is fixed.

In addition, in the laundry treating apparatus 1000 according to an embodiment of the present disclosure, since an operating signal for the second control UI 302*a* is input by the touch type in the variable UI section 302, the user may effectively operate the variable UI section 302, of which the display-on/off and type vary.

Although specific embodiments of the present disclosure have been described above and illustrated in the figures, it will be understood that the present disclosure is not limited to the described embodiments, and various modifications and changes can be made as other specific embodiments by a person ordinarily skilled in the art without departing from the spirit and scope of the present disclosure. Accordingly, the scope of the present disclosure should not be defined by the described embodiments, but should be defined by the technical idea described in the claims.

INDUSTRIAL APPLICABILITY

According to at least one of the embodiments of the present disclosure, the control panel is installed inside the cabinet cover that defines the exterior, and the control panel is not separated from the cabinet cover on the exterior. Therefore, the cabinet cover is designed as an integrated sheet metal product, so that the aesthetics and productivity of laundry treating apparatus can be improved.

In addition, according to at least one of the embodiments of the present disclosure, the control panel is installed inside the cabinet cover, and only a portion of the control panel is exposed outside through the first through hole provided in the cabinet cover. Therefore, the exterior design of the laundry treating apparatus can be implemented as a seamless structure by minimizing the exposure of the portions of the control panel that do not need to be exposed to the user.

In addition, according to at least one of the embodiments of the present disclosure, the touch screen is displayed through the transmissive area provided in a portion of the window, and the remaining portion of the window is provided as the non-transmissive area. Therefore, various exterior designs can be implemented regardless of the shape of the touch screen.

In addition, according to at least one of the embodiments of the present disclosure, since the first through hole is opened relatively greater than the touch screen, and the portion of the first through hole where the touch screen is not displayed is covered by the non-transmissive area of the window. Therefore, even when the open shape of the first through hole does not correspond to the planar shape of the touch screen, a design in which only the touch screen is displayed on the exterior can be implemented.

In addition, according to at least one of the embodiments of the present disclosure, since the touch screen has a height relatively smaller than the diameter of the first through hole that is provided in a circular shape. Therefore, even when the touch screen is not provided in a relatively expensive circular structure, a circular display on the exterior design can be implemented.

In addition, according to at least one of the embodiments of the present disclosure, UIs are arranged in the fixed UI section and the variable UI section, respectively, which are provided in the control panel, depending on the characteristics thereof. Therefore, control signals for a processing operation can be more conveniently input by the user.

In addition, according to at least one of the embodiments of the present disclosure, since the fixed UI section and the variable UI section of the control panel are provided as a non-transmissive area and a transmissive area, respectively, the variable UI section, of which the display-on/off and type vary, can be implemented on the touch screen.

In addition, according to at least one of the embodiments of the present disclosure, the fixed UI section is operated by a button rod contact type. Therefore, the fixed UI section, of which the display is fixed, can be easily operated by the user.

In addition, according to at least one of the embodiments of the present disclosure, the variable UI section is operated in the touch type. Therefore, the variable UI section, of which the display-on/off and type vary, can be effectively operated by the user.

In addition, according to at least one of the embodiments of the present disclosure, the window of the control panel is bonded to the inner surface of the cabinet cover, and the coating guide supporting the touch screen is fastened to the inner surface of the cabinet cover. Therefore, the control panel, which is directly coupled inside the cabinet cover, can be more easily and stably installed.

In addition, according to at least one of the embodiments of the present disclosure, the board cover on which the printed circuit board is installed is coupled to the rear surface of the coating guide. Therefore, the stably installed printed circuit board can be easily connected to the touch screen.

In addition, according to at least one of the embodiments of the present disclosure, the panel frame, which presses the rear surface of the control panel, is coupled to the inner surface of the cabinet cover. Therefore, the control panel can be prevented from being detached due to shock, vibration, or the like.

In addition, according to at least one of the embodiments of the present disclosure, the first sealing member is interposed between the window and the coating guide. Therefore, waterproofing and impact resistance performance can be secured for the coupling portion between the window and the coating guide.

In addition, according to at least one of the embodiments of the present disclosure, the second sealing member is interposed between the coating guide and the board cover. Therefore, waterproofing and impact resistance performance can be secured for the coupling portion between the coating guide and the board cover.

In addition, according to at least one of the embodiments of the present disclosure, the control panel is fastened to the hook protrusion protruding from the second through hole provided in the cabinet cover. Therefore, manufacturing efficiency can be improved by forming the hook protrusion for fastening the control panel when forming the second through hole.

In addition, according to at least one of the embodiments of the present disclosure, the hook at the lower end portion of the control panel is inserted into and fastened to the hook hole penetrating the hook protrusion in the longitudinal direction. Therefore, the control panel can be easily and stably fastened to the hook protrusion.

In addition, according to at least one of the embodiments of the present disclosure, the upper end portion of the control panel is screwed to the inner surface of the cabinet cover. Therefore, the coupling state between the cabinet cover and the control panel can be stably maintained.

In addition, according to at least one of the embodiments of the present disclosure, the control buttons are installed inside the cabinet cover, and some of these control buttons are exposed outside through the second through holes in the cabinet cover. Therefore, input of desirable control signals for which an intuitive operation, such as a power-on/off or start/stop operation, is desirable can be performed smoothly.

The invention claimed is:

1. A laundry treating apparatus for performing a processing operation for laundry, the laundry treating apparatus comprising:

a main body configured to accommodate the laundry;

a cover defining an exterior of the main body, the cover including a first through hole in a front upper end portion of the cover; and a control panel located at an inner surface of the cover, the control panel being partially exposed to an exterior of the cover through the first through hole to allow a user to input a control signal for the processing operation, the control panel including:

a window having:

an area corresponding to the first through hole, a first portion of the area being a transmissive area; and a remaining portion of the window, the remaining portion of the window being a non-transmissive area; and a touch screen located at a rear surface of the window, the touch screen being visible through the transmissive area.

2. The laundry treating apparatus of claim 1, wherein the touch screen is smaller than the first through hole, and wherein a second portion of the area corresponding to the first through hole is a non-transmissive area in which the touch screen is not displayed.

3. The laundry treating apparatus of claim 2, wherein the touch screen is planar.

4. The laundry treating apparatus of claim 2, wherein the control panel further comprises a shield layer located on the window, the shield layer defining the non-transmissive area of the second portion of the area corresponding to the first through hole and the non-transmissive area of the remaining portion of the window.

5. The laundry treating apparatus of claim 2, wherein the first through hole is a circular opening, and wherein the touch screen has a height smaller than a diameter of the first through hole.

6. The laundry treating apparatus of claim 2, wherein the touch screen has a quadrilateral shape.

7. The laundry treating apparatus of claim 1, wherein the control panel further includes:

a fixed UI section including a first control UI having a fixed display; and a variable UI section including a second control UI having a variable display.

8. The laundry treating apparatus of claim 7, wherein the variable display is configured to have a display on/off input and a variable laundry setting input.

9. The laundry treating apparatus of claim 7, wherein the fixed UI section is located in the non-transmissive area, and wherein the variable UI section is located in the transmissive area.

10. The laundry treating apparatus of claim 7, wherein the fixed UI section includes a button rod contact configured to allow a user to input an operation signal for the first control UI.

11. The laundry treating apparatus of claim 10, wherein the variable UI section includes a touch control configured to allow a user to input an operation signal for the second control UI.

12. The laundry treating apparatus of claim 1, wherein the control panel further incudes a coating guide configured to support a rear surface of the touch screen, the coating guide being located at the inner surface of the cover, and wherein the window has a front surface, a portion of the front surface is bonded to the inner surface of the cover adjacent the first through hole.

13. The laundry treating apparatus of claim 12, wherein the control panel further includes a first sealing member interposed between the window and the coating guide.

14. The laundry treating apparatus of claim 12, wherein the control panel further includes a board cover located at a rear surface of the coating guide, the board cover including a printed circuit board (PCB) connected to the touch screen.

15. The laundry treating apparatus of claim 14, wherein the control panel further comprises a second sealing member interposed between the coating guide and the board cover.

16. The laundry treating apparatus of claim 12, further comprising a panel frame configured to press a rear surface of the control panel, the panel frame being coupled to the inner surface of the cover.

17. The laundry treating apparatus of claim 1, wherein the cover further includes:

a second through hole located lower than a center of the first through hole in the front upper end portion of the cover; and a hook protrusion protruding rearward from a circumferential edge of the second through hole, and wherein the control panel is coupled to the inner surface of the cover.

18. The laundry treating apparatus of claim 17, wherein the hook protrusion includes a hook hole extending through the hook protrusion, and wherein the control panel further includes a hook provided at a lower end portion of the control panel, the hook being inserted into the hook hole.

19. The laundry treating apparatus of claim 18, further comprising fasteners fastening an upper portion of the control panel to the inner surface of the cover.

20. The laundry treating apparatus of claim 17, further comprising a control button located inside the cover, the control button being partially exposed to the exterior of the cover through the second through hole, the control button being configured to be brought into contact with the control panel when pressed by a user.

* * * * *